US005253031A

United States Patent [19]

Kinoshita et al.

[11] Patent Number: 5,253,031

[45] Date of Patent: Oct. 12, 1993

[54] METHOD OF FORMING A REFERENCE PATTERN FOR ADJUSTING IMAGE DENSITY IN COPYING MACHINES

[75] Inventors: Naoyoshi Kinoshita, Aichi; Keiji Kusumoto, Toyokawa; Katsuhiko Takeda, Okazaki; Hiroyuki Ideyama; Shizuo Yuge, both of Toyokawa, all of Japan

[73] Assignee: Minolta Camera Kabushiki Kaisha, Osaka, Japan

[21] Appl. No.: 707,682

[22] Filed: May 30, 1991

[30] Foreign Application Priority Data

May 31, 1990 [JP] Japan ..... 2-143319
Jun. 7, 1990 [JP] Japan ..... 2-149329

[51] Int. Cl.[5] ..... G03G 15/01

[52] U.S. Cl. ..... 355/327; 355/208; 355/246

[58] Field of Search ..... 355/208, 228, 326, 327, 355/245, 88, 246

[56] References Cited

U.S. PATENT DOCUMENTS 4,655,579 4/1987 Adachi et al. ..... 355/327
4,962,407 10/1990 Ueda ..... 355/208
4,969,012 11/1990 Suzuki ..... 355/212
5,066,985 11/1991 Yamanashi ..... 355/326
5,083,160 1/1992 Suzuki et al. ..... 355/208

FOREIGN PATENT DOCUMENTS 50-93436 7/1975 Japan .
53-63020 6/1978 Japan .
60-21081 2/1985 Japan .

*Primary Examiner*—Leo P. Picard
*Assistant Examiner*—Christopher Horgan
*Attorney, Agent, or Firm*—Willian Brinks Olds Hofer Gilson & Lione

[57] ABSTRACT

A copying machine capable of color copying includes a filter apparatus for color-separating scanning light for scanning original images, and the original images are copied by electrophotographic process. The filter apparatus includes mirror filters having color separation filters of blue, green and red, respectively deposited on mirror surfaces and a half mirror, and these mirrors are arranged apart from each other at an angle of 90°, so that the apparatus as a whole has a cylindrical shape. The light scanned the original images is reflected by the filter mirrors, and latent electrostatic images corresponding to respective colors are formed on a photoreceptor drum.

12 Claims, 22 Drawing Sheets

FIG. 10
FIG. 10A
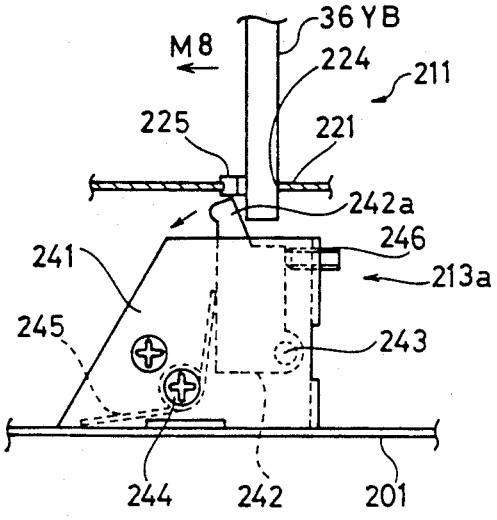
FIG. 10B
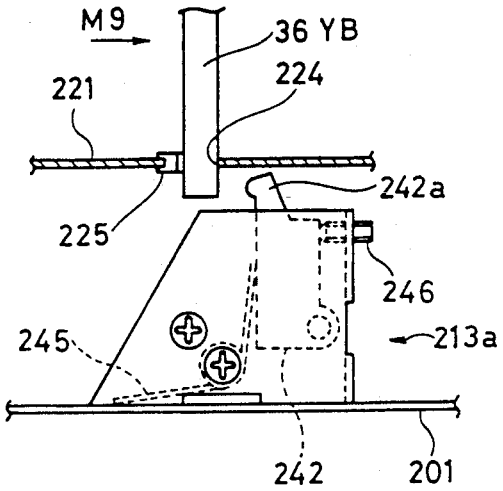
FIG. 10C
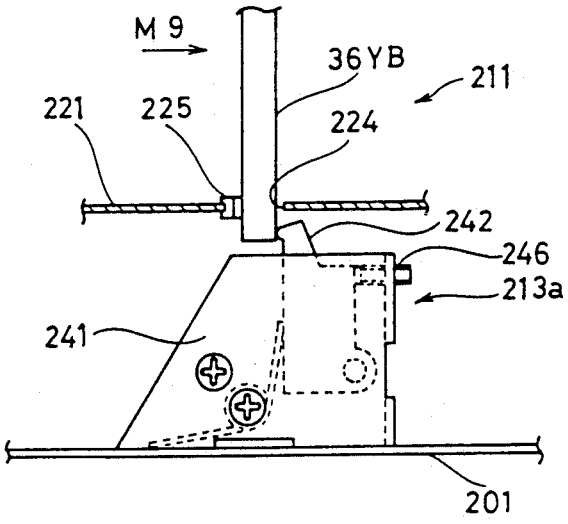

METHOD OF FORMING A REFERENCE PATTERN FOR ADJUSTING IMAGE DENSITY IN COPYING MACHINES

BACKGROUND OF THE INVENTION

Field of the Invention

The present invention relates to an image forming apparatus and a filter therefore and, more specifically, an image forming apparatus having an improved reference pattern for adjusting image density and to a filter therefore.

Description of the Related Art

Conventionally, optical filter apparatuses have been used in analog full color copying machines to separate light from an exposure light source reflected by an original into three primary colors A conventional filter apparatus comprises a filter holder provided rotatable about a frame, a plurality of filters having different colors attached in parallel to an axis of rotation of the filter holder, and a rotary driver including pulse motors and transmission mechanism for rotatably driving the filter holder. By rotating the filter holder, a filter of a prescribed color (wavelength) is selected (Japanese Patent Laying-Open No. 50-93436).

The above described conventional filter apparatus is a transmission type in which scanning light of a specific color is transmitted through the filter, so that the filter must be positioned to have the surface thereof orthogonal to the entering scanning light. Consequently, spectral characteristics tend to be uneven due to different angles of view corresponding to the widthwise position of the original, and hence reproduced color images tend to have misregistration of colors.

In the above described transmission type filter, path of the scanning light cannot be changed, unlike mirrors reflecting light, so that the number of mirrors necessary in a color copying machine cannot be reduced by using the filter apparatus. Therefore, an extra space for the filer apparatus is necessary, increasing space and cost.

In addition, it is difficult to fabricate filters having high transmissitivity. Generally, transmission type filters reduce quantity of light transmitted therethrough. Therefore, measures for making up for the quantity of light reduce by the filter, such as increase of luminous intensity of the light source and increase of sensitivity of photoreceptor in the color copying machine are necessary.

In the conventional filter apparatus described above, filters are fixed on the filter holder. Therefore, stop position of the filter is definitely influenced by precision of the angle of rotation of the filter holder An error of stop position of the pulse motor driving the filter holder and vibration in the transmitting mechanism directly cause errors in positioning of the filters. Consequently, it was very difficult to improve precision in positioning the filters.

In addition, precision in fixing the plurality of filters to the filter holder is different corresponding to each of the filters Therefore, even if the precision in positioning the pulse motor and the like is improved, there are variations among filters, causing errors at exposure points on the photoreceptor corresponding to each of the three primary colors Therefore, misregistration of color often occurs on the finally produced composite color images.

In order to eliminate such misregistration of colors, timing of starting scanning of a scanner must be corrected and controlled highly precisely, for example, to correct errors in positioning each of the filters, which makes the controlling circuit in the copying machine complicated.

In a copying machine utilizing electrophotographic process, an AIDC pattern (reference pattern for adjusting image density) is formed on the photoreceptor at a predetermined timing, which is detected (read) by a photoelectric AIDC sensor, and adjustment of image density is effected based on the detected signal.

The AIDC pattern is a rectangular black toner image formed after the formation of original images on the photoreceptor, for example. There have been the following three methods of forming the AIDC pattern.

In the first method, while the scanner is returning after the end of scanning of the original, an exposure lamp is turned off to form a black latent image on the photoreceptor, unnecessary portions of the latent image are erased by an eraser provided at the periphery of the photoreceptor to form a latent image corresponding to the AIDC pattern, and this latent image is developed.

In the second method, a shutter for intercepting scanning light is provided near an exposure position of the photoreceptor, and while the scanner is returning, this shutter is closed to prevent exposure of the photoreceptor to form a black latent image.

In the third method, a black pattern corresponding to the AIDC pattern is formed on the rear surface of an original scale provided at the starting edge portion of the platen glass, and this black pattern is exposed by the exposure lamp to form a latent image corresponding to the AIDC pattern on the photoreceptor.

However, in the above described first conventional method, there is an afterglow for a while after turning off of the exposure lamp and when the lamp is turned on again, there is some wait time until the lamp is fully lit. Therefore, it takes time to form the latent image of the AIDC pattern. Consequently, wait time until the next copying operation is made possible becomes longer, decreasing speed of copying. When multiple copies are to be taken, it has a significant influence.

In the second method, the shutter mechanism is necessary, which increases extra control and complicated structure of the copying machine, and further extra cost.

In the third method, density of the AIDC pattern formed on the photoreceptor depends on the unevenness or stain of the black pattern formed on the rear surface of the original scale and on the intensity of the exposure lamp, and therefore it is not easy to provide proper AIDC pattern.

SUMMARY OF THE INVENTION

Therefore, an object of the present invention is to enable effective use of space and light intensity by suppressing unevenness in spectral characteristics in an image forming apparatus.

Another object of the present invention is to provide a filter apparatus advantageous in both space and light intensity, in which unevenness of spectral characteristics is suppressed.

A further object of the present invention is to provide a proper AIDC pattern by a simple structure without decreasing speed of image formation in an image forming apparatus.

A still further object of the present invention is to provide a method of forming a proper AIDC pattern by a simple structure without decreasing speed of image formation.

A still further object of the present invention is to provide a method of image formation advantageous in both space and light intensity, in which unevenness of spectral characteristics is suppressed.

The above described objects of the present invention can be attained by an image forming apparatus comprising: a photosensitive member; an illumination system for illuminating images of an original; and a filter apparatus including a rotatable filter holder having a plurality of filter mirrors, for color-separating light reflected from the original images and for reflecting the reflected light to the photosensitive member.

Since the light separating filters also serve as reflection type mirrors for reflecting the original images, unevenness of spectral characteristic is suppressed, and therefore an image forming apparatus advantageous in both space and light intensity can be provided.

In accordance with another aspect of the present invention, an image forming apparatus comprises a photosensitive member; an illuminating system for illuminating images of an original; and a movable mirror apparatus for color-separating light reflected from the original images, in which the mirror apparatus directs the reflected light to the photosensitive member at a first position, and it directs the reflected light not to the photosensitive member at a second position. Further, the image forming apparatus includes a moving apparatus for moving the mirror apparatus between the first and second positions, a controller for controlling the moving apparatus for moving the mirror apparatus to the second position to adjust image density, an apparatus for forming a latent electrostatic image of a reference pattern for adjusting image density on the photosensitive member when the mirror apparatus is at the second position, and an apparatus for developing the latent electrostatic image of the reference pattern for adjusting image density.

The mirror apparatus for color separation is moved from the first position to the second position to intercept reflected light from the original image to the photosensitive member, and at the position of the intercepted photosensitive member, a latent image of a reference pattern for adjusting image density is formed. By developing this latent image, the reference pattern is formed. Consequently, an image forming apparatus can be provided in which a proper reference pattern for image density adjustment can be obtained without decreasing the speed of image formation and without complicating the structure.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIGS. 10A to 10C show processes of positioning filter mirrors.

DESCRIPTION OF THE PREFERRED EMBODIMENTS

Embodiments of the present invention will be described in the following with reference to the figures.

Figure 1:
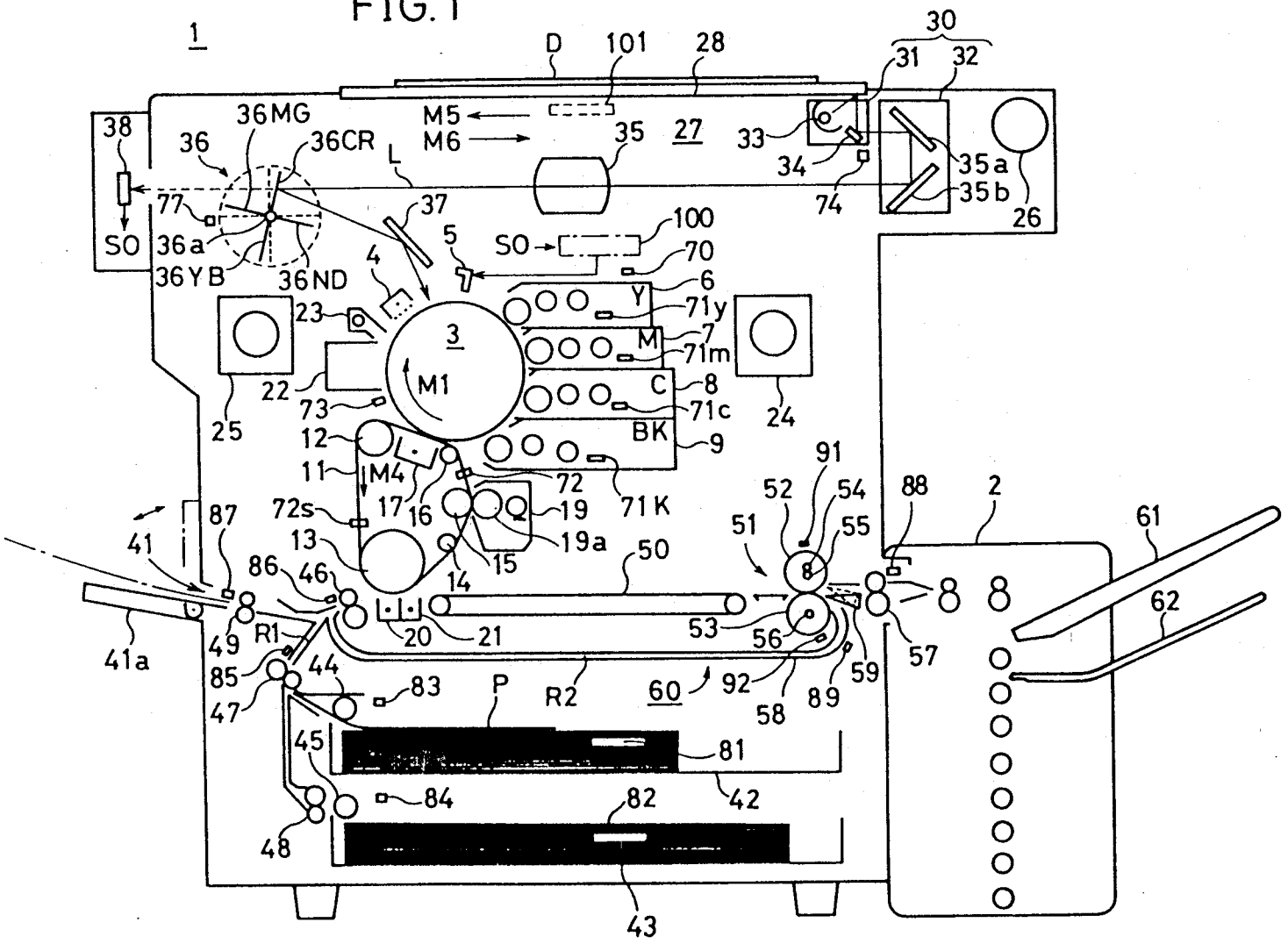
FIG. 1 is a schematic cross section showing a schematic structure of a copying machine in accordance with the present invention.

Referring to FIG. 1, a photoreceptor drum 3 is arranged rotatable in clockwise direction (in the direction of an arrow Ml) at slightly left side above the center of a copying machine 1. Around the photoreceptor drum 3 arranged are a corona charger 4, an edition eraser 5, developing units 6 to 9, a transfer belt 11 serving as an intermediate transfer medium, a cleaning apparatus 20 and a main eraser 23.

The photoreceptor drum 3 includes a photosensitive layer provided on the surface thereof, and the surface is uniformly charged when it passes by the main eraser 23 and the corona charger 4. The photoreceptor drum 3 is exposed to form latent images thereon by an optical system 27 which will be described later.

A latent image APE of an AIDC pattern AP is formed on the surface of the photoreceptor drum 3 by selectively erasing, by the edition eraser 5, a charge portion formed by intercepting exposure (scanning light) from the optical system 27. When the AIDC pattern AP is formed, the grid voltage VG of the corona charger 4 is set to a specific value.

Figure 2:
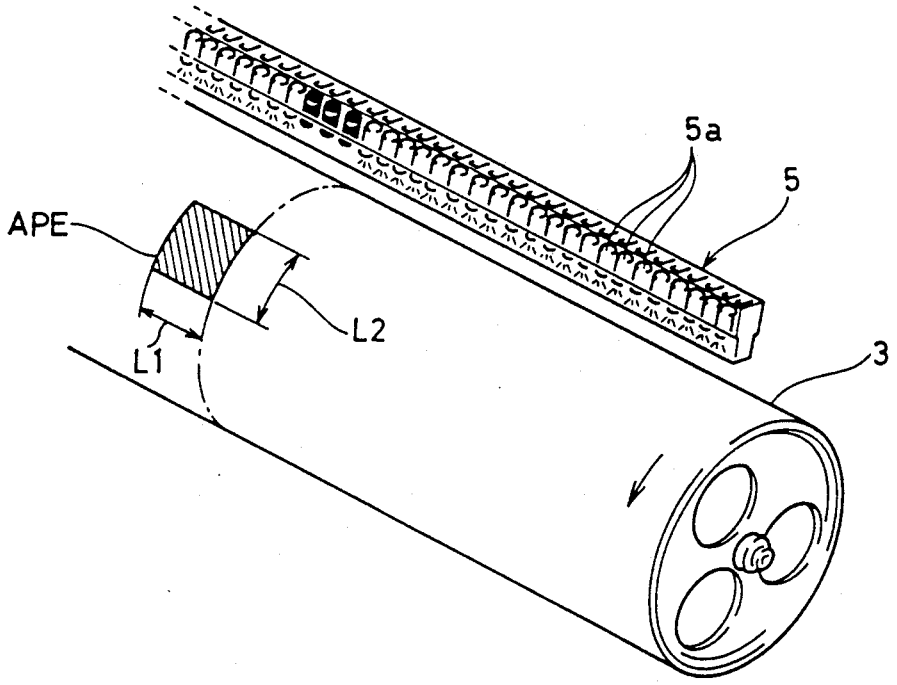
FIG. 2 shows state of formation of a latent image APE of the AIDC pattern using an edition eraser.

FIG. 2 shows the state of forming the latent image APE of the AIDC pattern AP by the edition eraser 5.

The edition eraser 5 is formed of LED arrays arranged in a line, and the LED array includes a number of LEDs 5*a* provided in a holder arranged along axial direction of the photoreceptor drum 3. By controlling lighting of the LEDs 5*a*, 5*a* . . . , the latent image or the charges on the photoreceptor drum 3 can be partially erased.

In order to form the latent image APE of the AIDC pattern AP by the edition eraser 5, the LEDs 5*a*, corresponding to the width L1 of the latent image APE are turned off for a timing corresponding to the length L2, and other LEDs 5*a* are kept on, and at other timings the LEDs are kept on. The latent image APE is developed by the developing units 6 to 9 and AIDC pattern AP is formed. The density of the formed AIDC pattern AP is detected by an AIDC sensor 73.

The timing for forming the latent image APE of the AIDC pattern AP and the method of intercepting scanning light will be described later.

The developing units 6, 7, 8 and 9 contain yellow toner (Y), magenta toner (M), cyan toner (C) and black toner (BK), respectively and toner density sensors (ATDC sensors) 71*y*, 71*m*, 71*c* and 71*k* are provided. A moisture sensor 70 for detecting moisture in the copying machine 1 is provided above the developing units.

A transfer belt 11 is used for temporarily holding the toner image developed on the photoreceptor drum 3 by the developing units 6 to 9 for transferring the toner image to a sheet of paper P (secondly transfer). The belt is wound around a plurality of rollers 10 to 16 and rotatable in counterclockwise direction (direction of an arrow M4) while being kept in constant contact with the photoreceptor drum 3.

A corona charger 17 is arranged inside the transfer belt 11 for primary transfer of the toner image from the photoreceptor drum 3 to the transfer belt 11. Outside the transfer belt 11 provided are a transfer charger 20 for secondly transfer, a separation charger 21 for separating the sheet of paper P from the transfer belt 11, and a belt cleaner 19 having a fur brush 19*a* for cleaning outer surface of the transfer belt 11. The fur brush 19*a* can be brought into contact with (for cleaning) or separated from the transfer belt 11, by selecting the position thereof.

Belt mark sensors 72 and 72*s* for detecting rotation angular position of the transfer belt 11 are arranged between the rollers 15 and 16 and between the rollers 12 and 13, respectively.

A platen glass 28 and an original size detecting apparatus 101 are arranged on the upper surface of the copying machine 1.

An optical system 27 is arranged at the upper portion of the copying machine 1. The optical system 27 comprises a scanner 30 movable in reciprocated manner in the direction of the arrow M5 (forward movement) and in the direction of the arrow M6 (backward movement) below the platen glass 28; a main lens 35 whose position is adjusted corresponding to the magnification rate; a filter apparatus 36 for color separation and exposure; a fixed mirror 37 for guiding scanning light L reflected by a mirror attached to a mirror apparatus 36 to an exposure point on the photoreceptor drum 3; and a color image sensor 38 receiving the scanning light L passed through the filter apparatus 36. The original D is scanned during the forward movement of the scanner 30 and the photoreceptor drum 3 is exposed.

The scanner 30 comprises an exposure lamp 33, a first slider 31 having a mirror 34, and a second slider 32 having mirrors 35*a* and 35*b*. During scanning of the original D, the first slider 31 moves forward at a speed of v/n (n represents copying magnification rate) where v represents peripheral speed of the photoreceptor drum 3, while the second slider 32 is driven by a scan motor, not shown, to move forward at the speed of v/2n. Completion of backward movement of the scanner 30, that is, whether or not the scanner 30 has returned to the home position, is detected by a scanner home switch 74 formed of a photosensor.

In the filter apparatus 36, a half mirror 36ND (the ratio of transmission and reflection is 6:4) and three filter mirrors 36YB, 36MG and 36CR are provided radially apart from each other by 90° about an axis 36*a* and parallel to the axis 36*a*. By the rotation of the filter apparatus 36, any one of these mirrors is selected and positioned. The filter mirrors 36YB, 36MG and 36CR are formed by depositing color separation filters of blue (B), green (G) and red (R) on the mirror surfaces, respectively, and the mirror and the filter are integrally formed. The filter mirrors are used corresponding to Y toner, M toner and C toner, respectively.

During exposure scanning for image formation, a reflection surface of a selected mirror is positioned inclined from the vertical surface by about 10° in clockwise direction, and the scanning light L is guided to the exposure point on the photoreceptor drum 3. In preliminary scanning for reading images on the original D prior to the exposure scanning, the half mirror 36ND is selected, and is positioned vertically so as to cross orthogonally the direction of entrance of the scanning light L, in order to improve MTF (modulation transfer function: indicating resolution) of the image sensor 38. By the side of the filter apparatus 36, a rotary position detecting sensor 77 for determining the home position is provided. FIG. 1 shows a state in which the filter mirror 36CR is selected and positioned at the image forming position.

In the following description, the half mirror 36ND and the filter mirrors 36YB, 36MG and 36CR are sometimes referred to as ND filter, B filter, G filter and R filter, respectively, based on the color separation characteristics thereof. These mirrors are sometimes referred to as the mirror 36*b*.

At the lower portion of the copying machine 1, an upper paper cassette 42 and a lower paper cassette 43 containing sheets of paper are attached. At a left side surface of the copying machine 1, a manual feed inlet 41 is provided which is opened when a door 41*a* is opened for manually feeding sheets of paper P. One of the paper cassettes 42 and 43 or the manual paper feed inlet 41 is used for feeding paper.

Pick up rollers 44 and 45 for feeding the sheets of paper P one by one, paper size sensors 81 and 82 for detecting size of the sheet of paper, and paper empty sensors 83 and 84 detecting that the sheet P is exhausted are provided in the paper cassettes 42 and 43, respectively. A manual sensor 87 for detecting manual insertion of the sheet P is provided at the manual paper feed inlet 41.

The sheet of paper P fed from the paper cassette 42 is transferred to the timing roller 46 by a paper feed roller 47, while a sheet of paper P fed from the paper cassette 43 is transferred to the timing roller 46 by the paper feed rollers 48 and 47 to be kept at respective positions for standby. The sheet of paper B inserted to the manual paper feed inlet 41 is conveyed to the timing roller 46 by a manual feed roller 49.

A paper detection sensor 85 for detecting presence/absence of a sheet of paper P on a paper feed path R1 between the paper feed roller 47 and the timing roller 46 is provided near the paper feed roller 47. A timing sensor 86 detecting front edge position of a sheet of paper P passing therethrough is provided near the timing roller 46.

A sheet of paper P kept in the standby state is transferred by the rotation of the timing roller 46 at the same timing with the transfer belt 11, and at the transfer position, toner image is secondly transferred from the transfer belt 11 to the sheet of paper P. Thereafter, the sheet of paper P is fed to a fixing unit 51 by means of a conveyor belt 50 having linear distance corresponding to a sheet of paper of A4 size.

The fixing unit 51 includes an upper roller 52 having heater lamps 54 and 55 and a lower roller having a heater lamp 56, for melting the toner image to be fixed on the sheet of paper P. Temperature sensors 91 and 92 formed of thermisters are provided near the rollers 52 and 53, respectively.

The sheet of paper P on which desired copied images are formed by the fixing of the toner images is fed to a sorter 2 by a discharge roller 57 having a discharge sensor 88 arranged near, and then it is discharged to a container tray 61 of the sorter 2 or to a bin 62 for sorting.

In the copying machine 1 of the present invention, a feedback apparatus 60 for re-fixing used in OHP mode copying is provided. The feedback apparatus 60 is used for feeding back a sheet of paper P which have passed the fixing unit 51 to the inlet (on the side of the conveyor bet 50) of the fixing unit 51 again. The feedback apparatus 60 comprises a conveyor mechanism 58 having a feedback path R2 extending from the outlet side of the fixing unit 51 to the above described timing roller 46; and switching claw 59 for switching the direction of conveying the sheet of paper P fed from the fixing unit 51 either to the discharge roller 57 or to the feedback path R2. The switching claw 59 is driven by a solenoid, not shown. The conveyor mechanism 58 includes a guide plate and a transporter such as a belt or a roller provided at approximate portions. A feedback paper detecting sensor 89 for detecting presence/absence of a sheet of paper P on the feedback path R2 is arranged near the switching claw 59 in the conveyor mechanism 58.

By this feedback apparatus 60, a plurality of fixing operations can be effected on a sheet of paper P without manual re-feeding of the paper.

In the copying machine 1, a main motor 24 for driving various portions related to paper feeding and transportation, a PC motor 25 for driving the photoreceptor drum 3 and the transfer belt 11, a cooling fan 26 and so on are provided.

The copying machine 1 structured as described above enables formation of a monocolor copied image of a single toner color, that is, Y, M, C or BK; composite monocolor copied images of R (Y and M), G (Y and C) and B (M and C) provided by overlapping toner images of two colors out of the three primary colors Y, M and C; and color (full color) copied images provided by overlapping toner images of the three primary colors. Switching of such copy mode is effected by various switches arranged on an operation panel, not shown.

When a copied image of a single toner color or a copied image of composite monocolor is to be formed, an original D is exposed and scanned by using the half mirror 36ND, a latent image formed on the photoreceptor drum 3 is developed by using one of the developing units 6 to 9 corresponding to the designated color, and the toner image is transferred to the transfer belt 11. If the copied image of composite monocolor is to be formed, exposure and scanning by the half mirror 36ND is effected again on the same original D, and a toner image developed by another one of the developing units 6 to 9 is transferred to the transfer belt 11, and the toner images of two colors are overlapped on the transfer belt 11.

When a color copied image is to be formed, four colors of toner, that is, Y, M, C and BK is used in turn, so as to improve fidelity of black portion. Namely, four times in total of exposure and scanning are effected on the same original D, and the filters B, G, R and ND and developing units 6 to 9 are selectively switched at every scanning. Latent images provided by color separation of the original D are formed and developed, toner images are transferred successively onto the transfer belt 11, and the toner images of respective colors are overlapped on the transfer belt 11. When the toner images are overlapped (hereinafter referred to as "overlapping transfer"), the toner images must be transferred to the same position on the transfer belt 11. Therefore, in the copying machine 1 of the present embodiment, timing of starting movement of the scanner 30, that is, timing of starting formation of latent images on the photoreceptor drum 3, is controlled referring to the timing of generation of the belt mark signal S10 from the above mentioned belt mark sensor 72 or 72*s*.

When color copied images are to be formed, preliminary scanning is carried out, so that color image portions including chromatic colors of the original image are distinguished in advance from monochrome image portions including achromatic color only. When images are formed by Y toner, M toner and C toner, respectively, latent images corresponding to the monochrome image portion are erased prior to development by the edition eraser 5. When images are formed by the BK toner, latent images corresponding to the color image portions are erased before development. Namely, color image portions are reproduced by overlapping transfer of Y, M and C toners, and the monochrome image portions are reproduced only by the BK toner. Consequently, images having thin lines such as character or drawings generally represented in black can be copied clearly without misregistration of color, and color images such as color photographs can be copied naturally with high fidelity of colors.

Figure 3:
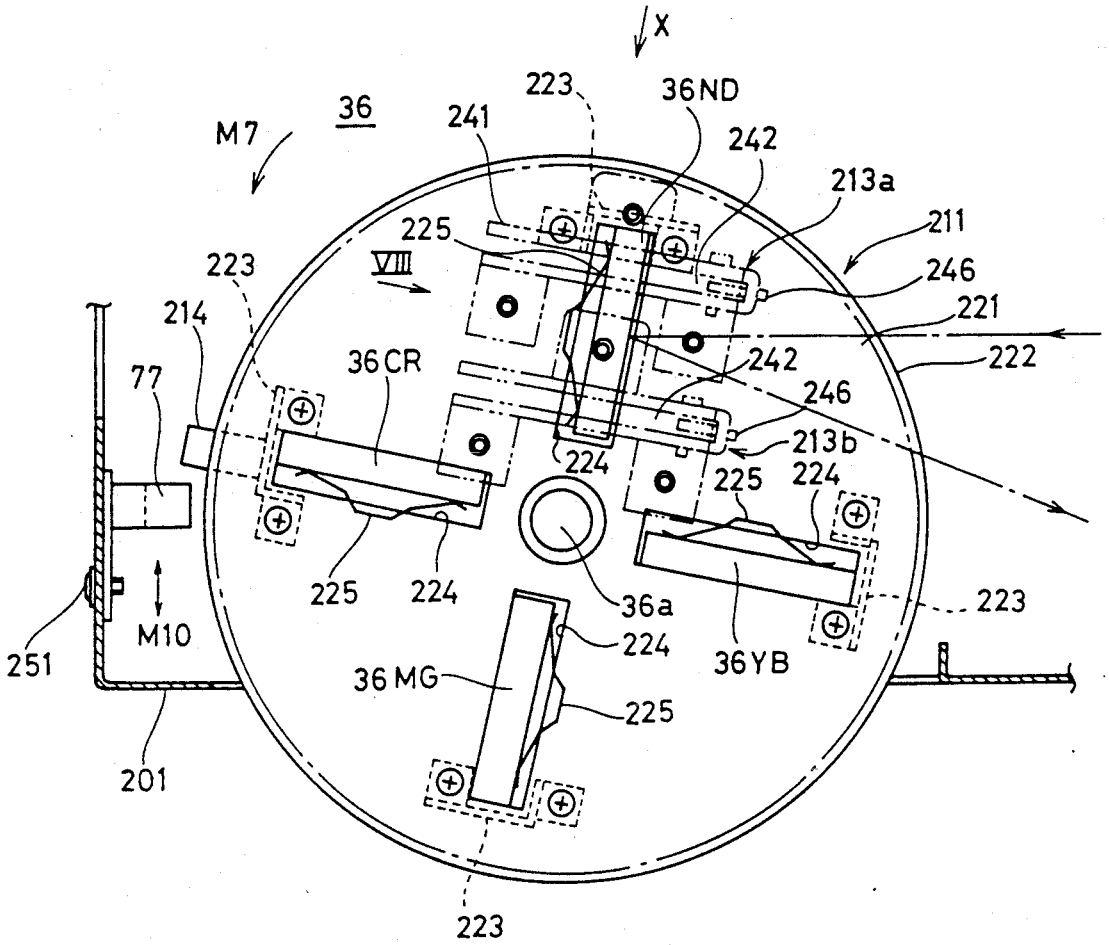
FIG. 3 is a front view of a filter apparatus in accordance with the present invention.
Figure 4:
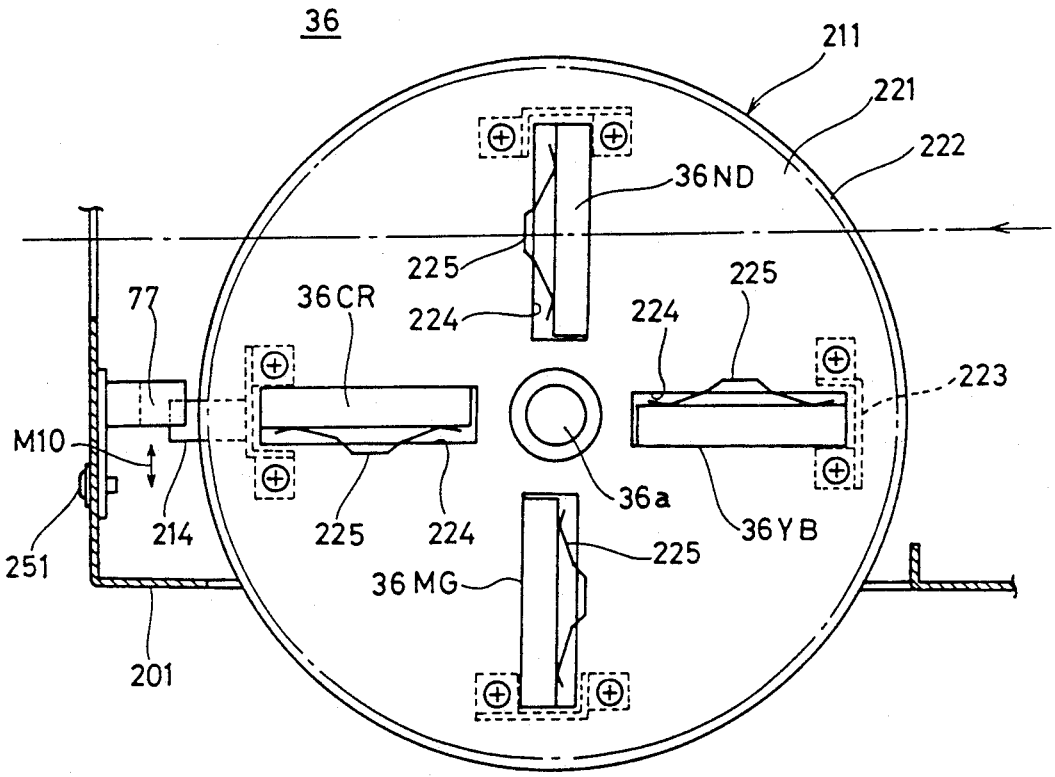
FIG. 4 is a plan view when the filter apparatus is at a home position.
Figure 5:
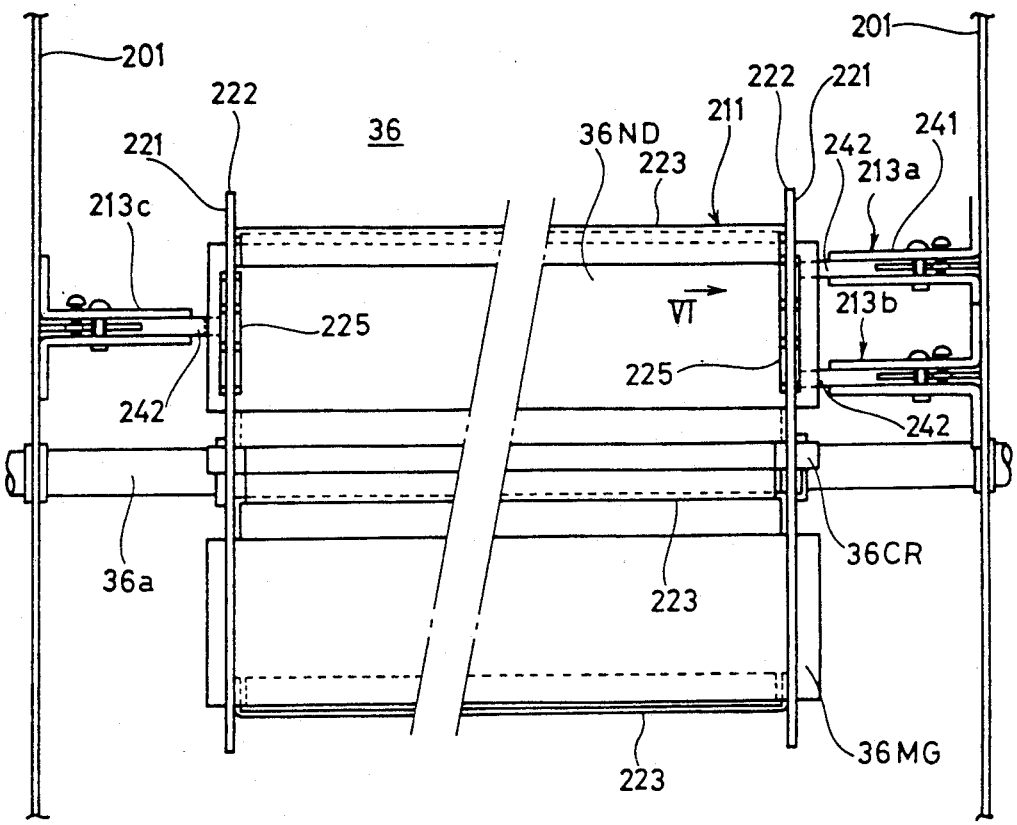
FIG. 5 is a left side view of the filter apparatus.
Figure 6:
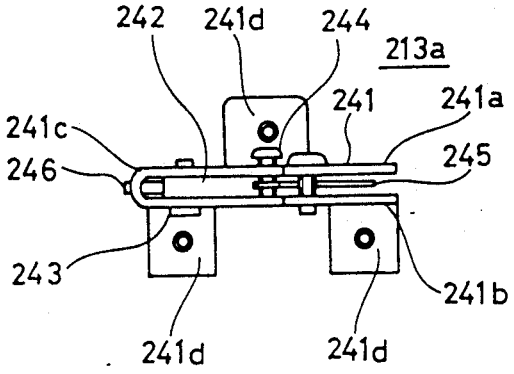
FIG. 6 shows a stopper apparatus of the filter apparatus.
Figure 7:
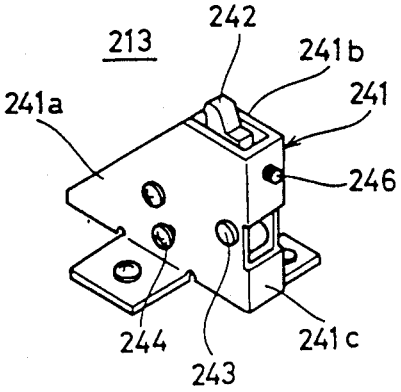
FIG. 7 is a perspective view of the stopper apparatus.
Figure 8:
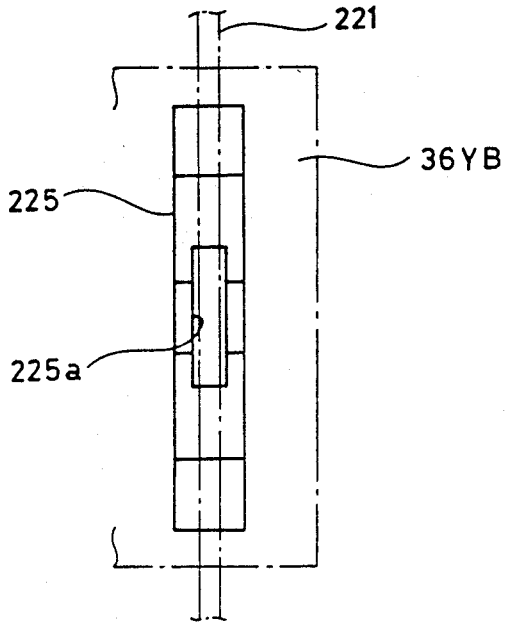
FIG. 8 is a view taken along the arrow VIII in FIG. 3.
Figure 9:
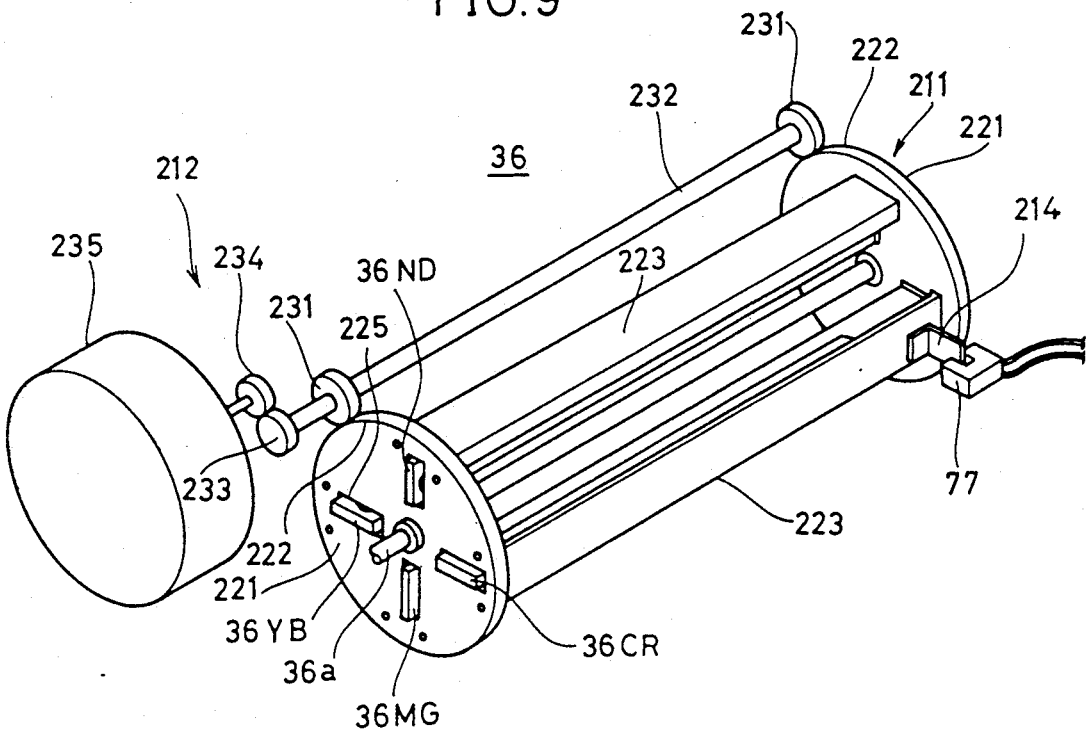
FIG. 9 is a perspective view of the filter apparatus.

FIGS. 3 and 4 are front views of the filter apparatus in accordance with the present invention, FIG. 5 is a left side view of the filter apparatus 36, FIG. 6 is a cross section of a stopper apparatus 213 in the filter apparatus 36 taken from the direction of an arrow VI of FIG. 5, FIG. 7 is a perspective view of the stopper apparatus 213, FIG. 8 is a cross section of a spring member 225 in the filter apparatus 36 taken from a direction of an arrow 8 of FIG. 3, and FIG. 9 is a perspective view of the filter apparatus 36.

FIG. 3 shows a state in which the half mirror 36ND is selected and positioned, while FIG. 4 shows a state in which the filter apparatus 36 is at the home position, that is, the half mirror 36ND is vertically positioned. FIG. 9 shows the filter apparatus 36 of FIG. 1 viewed from the deeper side on the upper left portion. In FIG. 3, the stopper apparatus 213 is represented by a dotted line. In FIGS. 4 and 9, the stopper apparatus 213 is omitted, and in FIGS. 3 and 4, rotary driving portion 212 is omitted.

Referring to FIGS. 3 to 9, the filter apparatus 36 includes an axis 36*a* fixed to a frame 201 of the copying machine 1; a filter holder 211 rotatably supported by the axis 36*a*; filter mirrors 36*b* (half mirror 36ND and filter mirrors 36YB, 36MG and 36CR) attached to the filter holder 211 in parallel to the axis 36A; a rotary driving portion 212 for rotatably driving the filter holder 211

(see FIG. 9); and a stopper apparatus 213 (213*a* to *c*) for positioning the filter mirrors 36*b*, attached to the frame 201.

Referring to FIG. 5, the filter holder 211 includes two disc-shaped side plates 221, 221 having gears 222 provided on the outer peripheral surfaces, and stay members 223, 223 . . . extending in axial direction and fixed by screws at four portions spaced equally from each other at the peripheral direction to couple the two side plates 221.

Each of the side plates 221 has rectangular support holes 224, 224 . . . extending radially in the radial direction about the axis 36*a* inside each of the stay members 223.

The above described filter mirror 36 is inserted to the support hole 224. Since the widthwise dimension of the support hole 224 is larger than the thickness of the filter mirrors 36*b*, the filter mirror 36*b* is movable in the peripheral direction in the support hole 224. The filter mirror 36*b* is pushed to the tangential direction (opposite to the direction of the arrow M7) to the left rotation direction shown in FIG. 3, by means of a spring member 225 provided in the support hole 224.

The spring member 225 is formed of a resilient thin steel plate bent at an angle, with a fitting hole 225*a* provided at the vertex. The fitting hole 225*a* is fitted in a portion around the support hole 224 of the side plate 221 with both end portions of the spring member 225 continuously pressing the filter mirrors 36*b*, whereby the spring member 225 is prevented from slipping.

Referring to FIG. 9, the rotary driving portion 212 includes gears 231, 231 engaged with gear 221 on the outer peripheral surface of the side plate 221, an axis 232 rotatably driving the gears 231, a gear 233 provided at an end portion of the axis 232, a gear 234 rotatably driving the gear 233, and a pulse motor 235 rotatably driving the gear 234.

Therefore, when the pulse motor 235 rotates in the forward direction or in the reverse direction, the driving force is transmitted to the gears 231, 231 through the axis 232 to simultaneously drive both side plates 221, and thus rotates the filter holder 211 in the forward or reverse direction.

Referring to FIGS. 6 and 7, each stopper apparatus 213 comprises a holder 241 formed by bending a steel plate or the like to have a cross section approximately rectangular with one side open; a stopper claw 222 attached rotatable about an axis pin 243 provided across both side plates 241*a*, b of the holder 241; a screw pin 244 for adjusting distance between the side plates 241*a* and *b* of the holder 241; a coil spring 245 attached to the screw pin 244 for energizing the stopper claw 242 to rotate toward rear plate 241*c* of the holder 241; and an adjusting screw 246 for regulating rotation angle of the stopper claw 242.

Two stopper apparatuses 213*a* and *b* are provided on the front side of the copying machine 1 of FIG. 1 and one stopper apparatus 213*c* is provided on the rear side of the copying machine 1 fixedly of the frame 201 by means of screws, utilizing fixing portion 241*d* provided integrally with the holder 241.

Referring to FIG. 3, a detecting plate is provided on the stay member 223 at the position of the filter mirror 36CR for operating the above described rotation position detecting sensor 77. The rotation position detecting sensor 77 is provided in an elongate hole provided in the fame 201 by means of a screw 251. By releasing the screw 251, the position of the detecting sensor 77 may be adjusted in the direction of M10 of FIG. 3 with respect to the frame 201. Therefore, the position of operation of the rotation position detecting sensor 77, that is, the home position, can be adjusted.

The positioning operation of the filter mirrors 36*b* will be described.

First, positioning of the half mirror 36ND at the vertical attitude, namely, positioning of the filter apparatus 36 at the home position will be described.

The half mirror 36ND is positioned vertically by rotating the filter holder 211 in the forward direction by the rotation of the pulse motor 235, and by stopping the pulse motor 235 when the detecting sensor 77 detects the detecting plate 214.

Namely, the operation position of the rotation position detecting sensor 77 is the home position of the half mirror 36ND. The home position can be adjusted by adjusting the detecting sensor 77 by releasing the screw 251, as described above.

Positioning of the filter mirrors 36YB, 36MG, 36CR and the half mirror 36ND will be described.

FIGS. 10A to 10C are cross sections taken along the line X of FIG. 3 showing processes of positioning the filter mirror 36YB.

FIGS. 10A to 10C shows processes of positioning the filter mirrors 36YB which is selected.

For example, from a state in which the half mirror 36ND is selected and positioned as shown in FIG. 3, the filter mirror 36YB moves to the direction of the arrow MB of FIG. 10A, as the filter holder 211 rotates in the forward direction (in the direction of the arrow M7) by the rotation of the pulse motor 235. Consequently, the contact portion 242*a* of the stopper claw 242 is pressed in the opposite direction to the biasing force of the coil spring 245 by an end portion of the filter mirror 36YB.

Consequently, the stopper claw 242 rotates in the left direction of the figures against the biasing force of the coil spring 245, and the filter mirror 36YB moves over the contact portion 242*a* of the stopper claw 242 to realize the state shown in FIG. 10B.

The filter holder 211 stops when the filter mirror 36YB has completely passed over the contact portion 242*a*. Then, the filter holder 211 rotates in the reverse direction (reverse to the direction of M7) by a predetermined angle by the reverse rotation of the pulse motor 235 and stops there.

Consequently, the filter mirror 36YB moves for a predetermined distance to the direction of the arrow M9 of the figure and stops there, thereby realizing the state of FIG. 10C.

In the state of FIG. 10C, the reflection surface of the filter mirror 36YB is in contact with the contact portion 242*a* of each stopper apparatus 213, and is resiliently pressed to the contact portion 242*a* by the spring member 225. Namely, both the reflecting surface and the rear surface of the filter mirror 36YB are apart from the periphery of the support hole 224 of the side plate 221. Namely, in this state, the filter mirror 36YB is free from the side plate 221 of the filter holder 211, and the reflection surface is supported by three points, that is, by the contact portions 242*a* of the three stopper apparatuses 213.

Therefore, the position of the filter mirror 36YB is determined only by the positions of the contact portions 242*a* of the three stopper apparatuses 213. Namely, it is not influenced by the angle of rotation of the pulse motor 235 or of the filter holder 211, not influenced by the precision in processing the side plates 211 or the support hole 224, and therefore the positioning of the filter mirror 36YB can be done highly precisely. Since positioning is carried out in the similar manner for the half mirror 36ND and the filter mirrors 36YB, 36MG and 36CR, there is no positioning error among these mirrors.

Since the rotation of the pulse motor 235 is transmitted to the two gears 231, and the side plates 221 are driven simultaneously by the two gears 231, the filter holder 211 will not be distorted, and therefore the filter mirror 36*b* can be positioned precisely. Since the filter holder 211 does not have to be very rigid, the filter holder 211 may be made light, driving force of the pulse motor 235 can be reduced, and the apparatus itself can be made light and compact.

The actual order of positioning of the filter mirrors 36*b* are as follows. In monocolor copying (including composite monocolor), the half mirror 36ND is selected and positioned.

In full color copying, the filters are positioned at the home position at first, and then the filter mirrors 36YB, 36MG, 36CR and the half mirror 36ND are selected and positioned in this order.

Then, operation of the filter apparatus 36 for forming a latent image APE of the AIDC pattern AP will be described.

When a monocolor image is to be formed, the filter apparatus 36 rotates to move to a standby position while the scanner 30 has scanned the original D and is returning to its position. Consequently, scanning light from the exposure lamp 33 is intercepted, and a latent image APE corresponding to the AIDC pattern AP is formed on the photoreceptor drum 3 by the edition eraser 5. Then, the filter apparatus 36 returns to the original image forming position and the next copying operation is done.

If a full color image is to be formed, the filter apparatus 36 rotates to position a mirror 36*b* of the next color at an image forming position while the scanner 30 has scanned the original D and is returning to its position. In this period, the scanning light from the exposure lamp 33 is intercepted, and the latent image APE is formed in the similar manner as described above. When the mirror 36*b* of the next color is positioned at the image forming position, next scanning is started.

The AIDC pattern AP is not formed for all colors, as described later. The pattern may not be formed every time for one copy.

Figure 11:
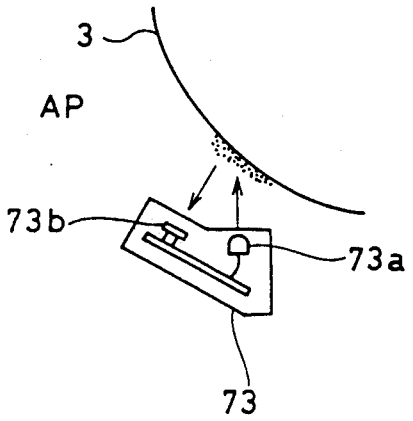
FIG. 11 shows an AIDC sensor.

FIG. 11 shows an AIDC sensor 73.

The AIDC sensor 73 includes a light emitting diode 73*a* and a light receiving element 73*b*.

The light emitting diode 73*a* is arranged such that the light emitted therefrom is directed to the photoreceptor drum 3. The light receiving element 73*b* is arranged not to receive regular reflection from the photoreceptor drum 3.

Namely, when toner is attached on the surface of the photoreceptor drum 3, the light from the light emitting diode 73*a* is irregularly reflected by the toner, which irregularly reflected light is received by the light receiving element 73*b*, and a detecting signal S1 is outputted. However, if there is no toner, the light receiving element 73*b* does not receive light.

Figure 12:
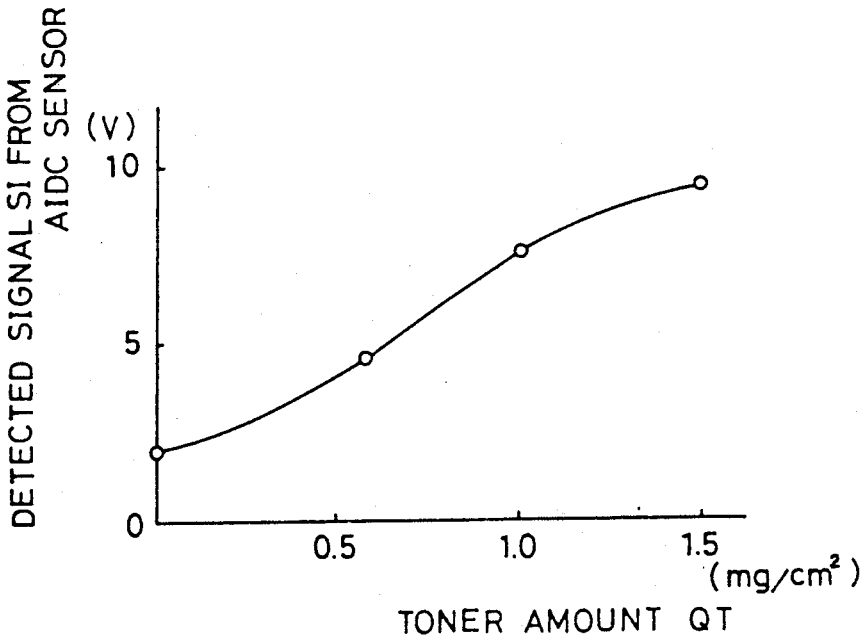
FIG. 12 shows relation between toner amount QT and detecting signal S1.

FIG. 12 shows one example of a relation between toner amount QT on the photoreceptor drum 3 and the detecting signal S1.

The amount of light received by the light receiving element 73*b* is increased as the amount of toner on the photoreceptor drum 3 is increased, that is, as the toner image has higher density. The magnitude of the detected signal S1 output from the light receiving element 73*b* is increased as much light is received.

Therefore, the detecting signal S1 increases as the density of the toner image becomes higher. The image density is adjusted by comparing the magnitude of the detected signal S1 with a reference value and by feeding back the result of comparison to the control of the corona charger 4, the exposure lamp 33 and the developing units 6 to 9.

The fluctuation of toner amount on the photoreceptor drum 3 due to change in environment or change with time can be regarded as approximately the same for respective toners, that is, Y, M, C and BK. Therefore, even if a full color copying is to be done, it is not necessary to detect density by forming the AIDC pattern AP for all of the four colors. Only an AIDC pattern AP have to be formed for one color. The density of other colors may be calculated based on the detected signal S1.

In this embodiment, when full color copying is done, the AIDC pattern AP is formed only for Y, and other colors, that is, M, C and BK are corrected based on the detected signal S1 for Y.

Figure 13:
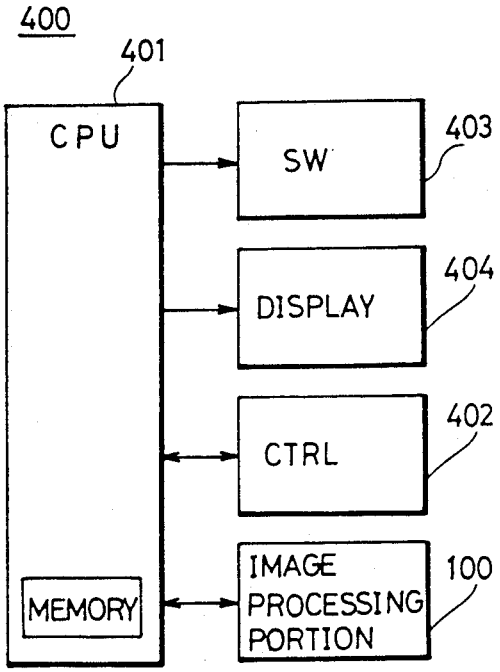
FIG. 13 is a block diagram of a control circuit in the copying machine.

FIG. 13 is a block diagram of a control circuit 400 of the copying machine 1.

The control circuit 410 includes a CPU (Central Processing Unit) 401 controlling the operation of the copying machine 1 as a whole, and controls driving of various portions such as the scanner 30, the exposure lamp 33, the main lens 35, the corona charger 4 and the pulse motor 235. The control circuit 400 includes a controller 402 controlling the edition eraser 5 to form the AIDC pattern AP; a correcting dip switch for adjusting positioning of the filter apparatus 36, which will be described later; various switches 403 and a display portion 404 arranged on an operation panel and the like, not shown; and image processing portion 100 for processing images by using image sensors 38 and the like. Although not shown, various sensors such as the AIDC sensor 73, the scanner home switch 74 and the rotation position detecting sensor 77 described above are connected to the CPU 401 through appropriate interface.

The CPU 401 contains a memory for storing programs, data, and data table for obtaining correction data and so on.

A control circuit for controlling the corona charger 4 and a regulator for exposure lamp, which is a portion of the controller 402, has several bits of data lines controlled by the CPU 401, and output voltage therefrom can be changed by changing data from the CPU 401.

The operation of the copying machine 1 with respect to the formation of the AIDC pattern AP will be described with reference to the flow chart.

Figure 14:
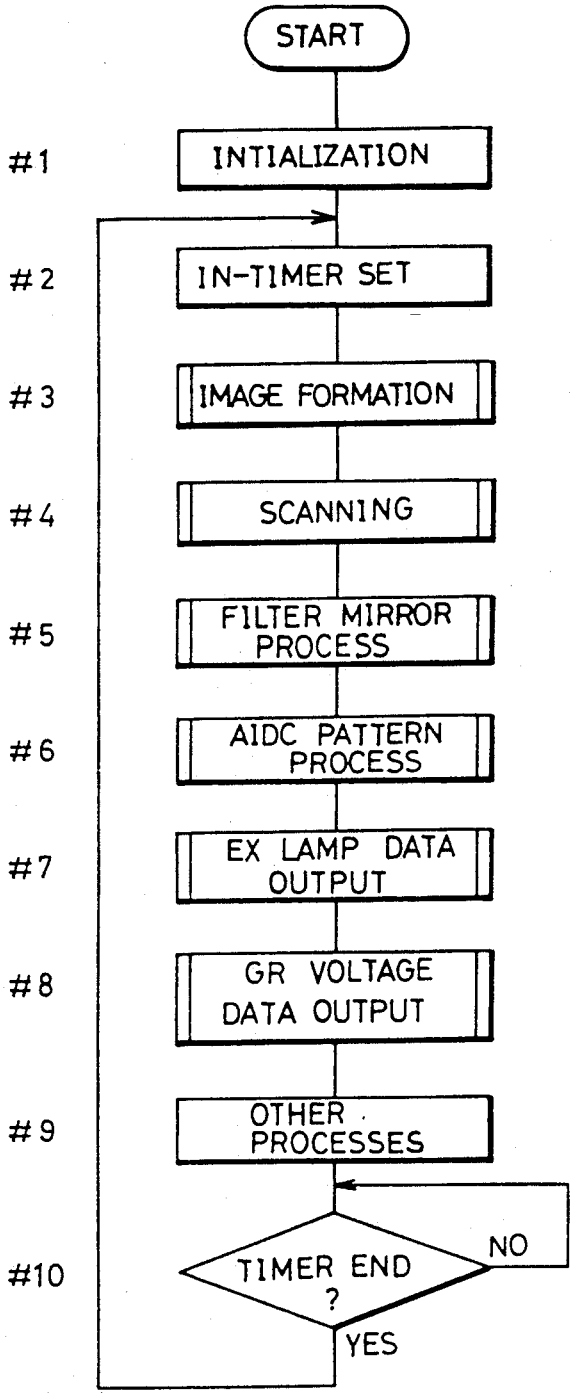
FIG. 14 is a flow chart schematically showing the operation of the CPU.
Figure 15A:
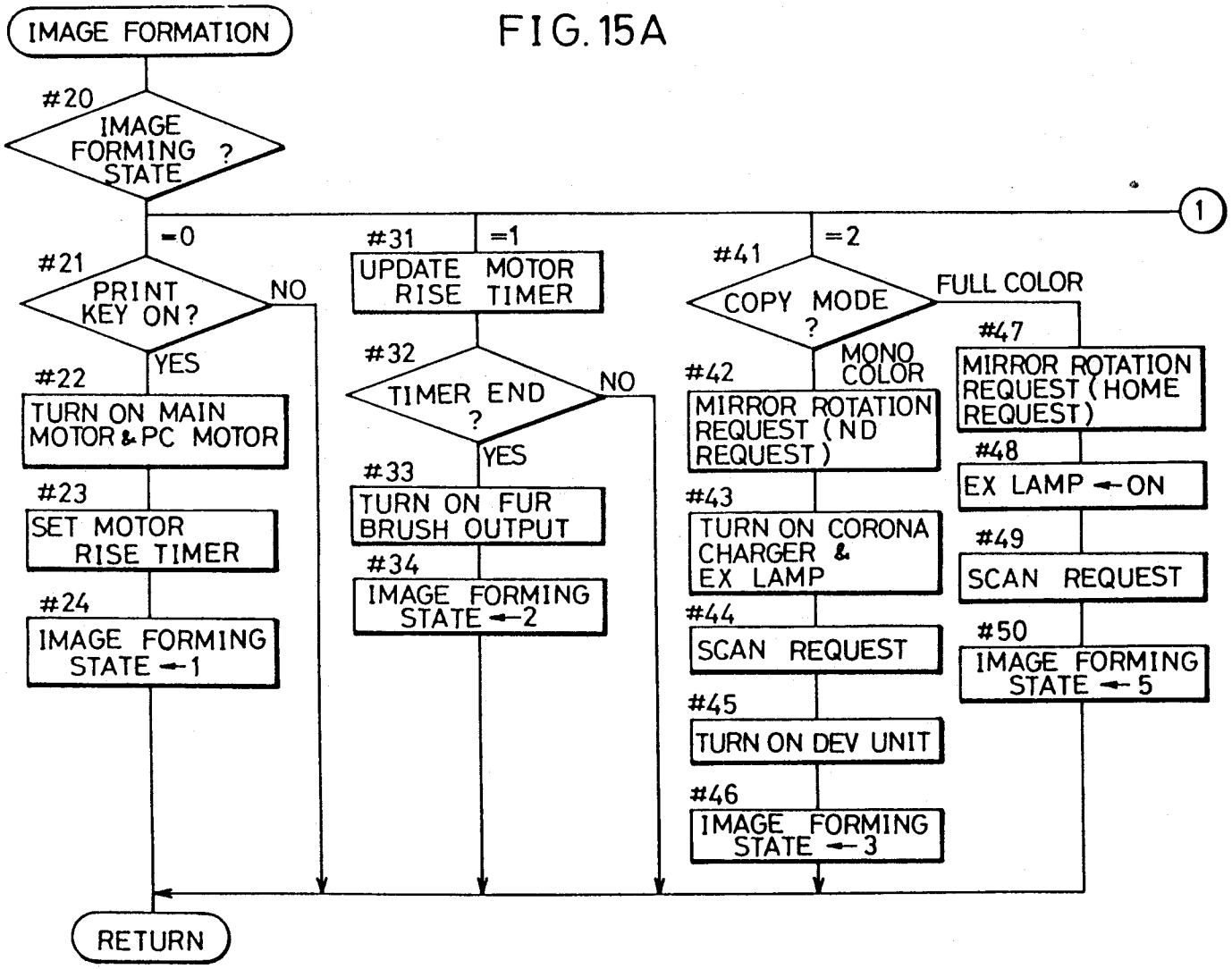
FIGS. 15A to 15D are flow charts of image taking process.
Figure 15B:
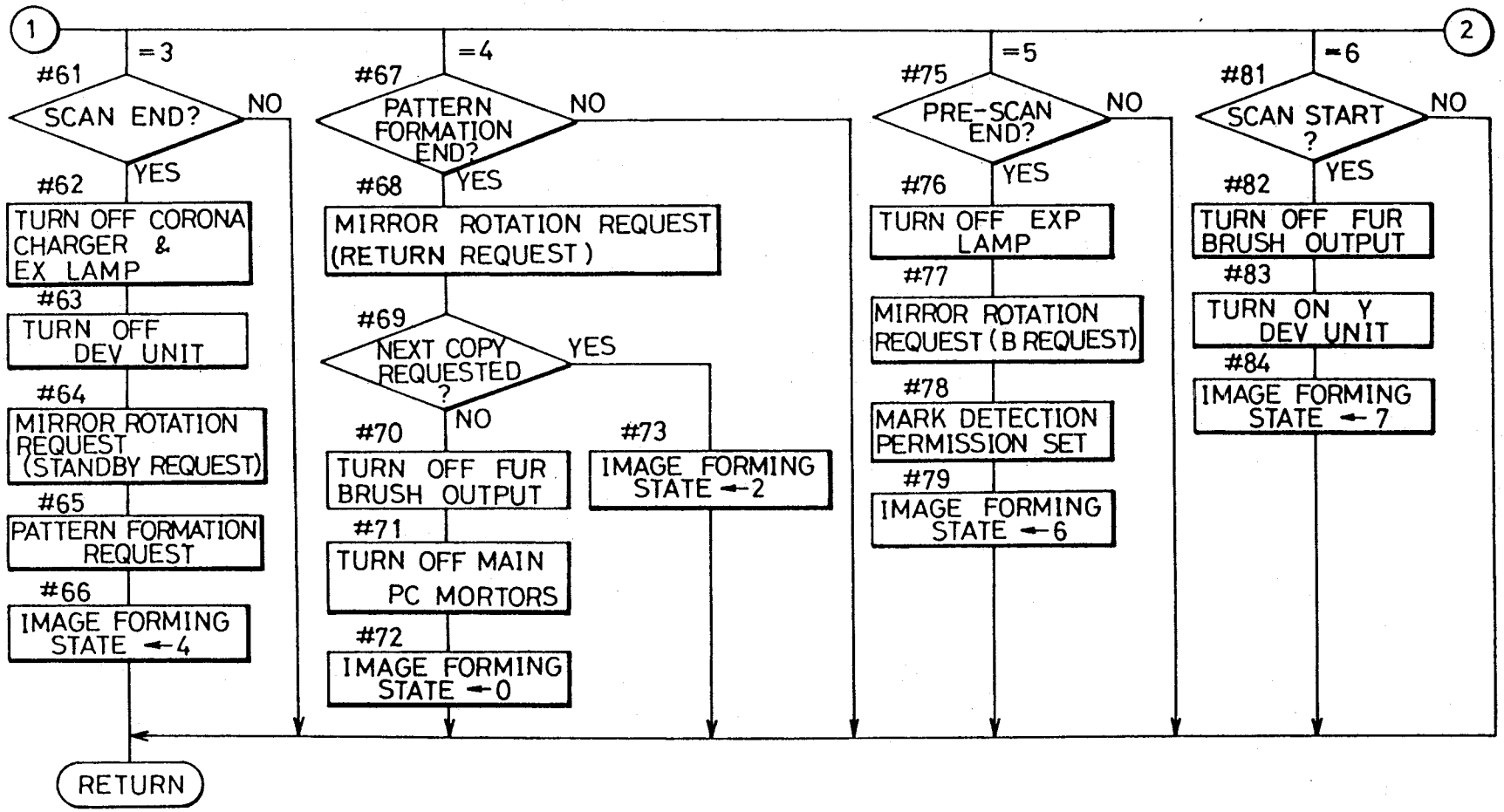
Figure 15C:
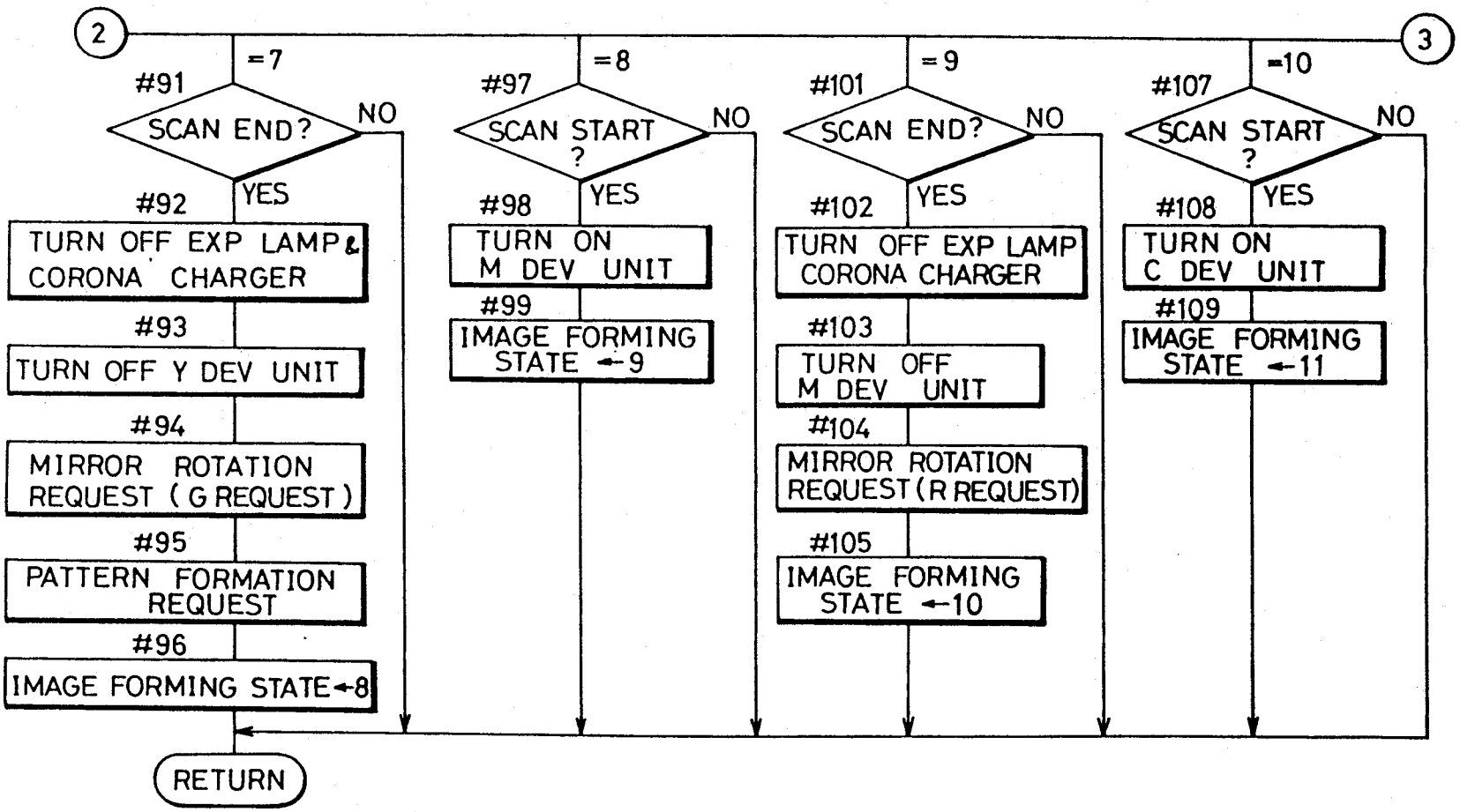
Figure 15D:
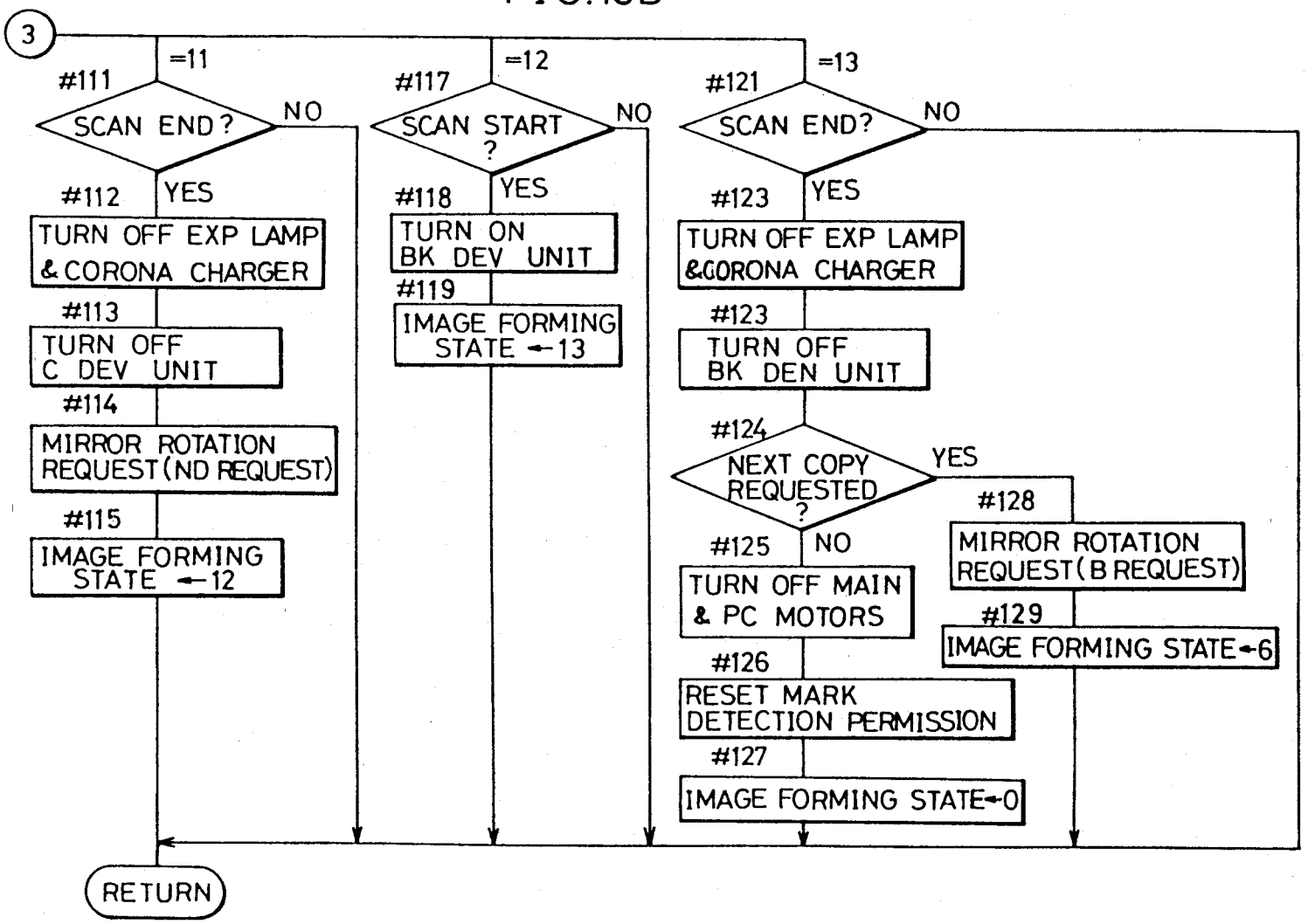

FIG. 14 is a main flow chart schematically showing the operation of the CPU 401.

When the power is turned on and the program starts, initialization of registers and peripheral interface is carried out (step #1). An internal timer for regulating length of 1 routine of the CPU 401 is set (step #2).

In step #3, image forming process related to the electrophotographic process is carried out, and in step #4, scanning process for scanning the original D is carried out.

In step #5, a filter mirror processing for controlling the filter apparatus 36 is executed.

In step #6, an AIDC pattern processing is executed for forming the AIDC pattern AP. Thereafter, an exposure lamp data output process (step #7) and a grid voltage data output process (step #8) are executed.

In step #9, a series of copying sequence processes including a belt mark detecting process for determining timing of overlapping transfer, paper feeding process for controlling feeding and transmission of the paper P, a manual feed receiving process for determining timing of manual paper feed from the manual paper feed inlet 41, a temperature adjusting process for adjusting temperature of the fixing unit 51, a belt cleaning process for cleaning the transfer belt 11, a lens process for controlling movement of the main lens 35 corresponding to the copying magnification, and input process for receiving signals from operation keys on the operation panel OP are executed.

After these processes are executed, waiting of the internal timer is conducted in step #10 and the flow returns to step #2. Consequently, the length of 1 routine is kept constant, and while the power is on, various processes from step #2 to step 10 are repeated.

In the image forming process of step #3, a process for image formation is started when a print key, not shown, is pressed. A filter mirror rotation request flag for selecting a predetermined filter mirror 36*b* corresponding to the copy mode is set.

Namely, if the copy mode is a monocolor mode (including composite monocolor mode), a filter mirror rotation request flag designating selection of the half mirror 36ND is set, and then predetermined electrophotographic process is executed.

If the copy mode is a full color mode, a filter mirror rotation request flag designating positioning of the filter apparatus 36 at the home position is set, and then, at a prescribed the timing, preliminary scanning by the scanner 30 is carried out. In the following, the home position may be referred to as "HOME".

Filter mirror rotation request flags are set to designate selection and positioning of the filter mirrors 36YB, 36MG and 36CR and the half mirror 36ND successively, and while the flags are set, scanning of the original D by the scanner 30 and developing process by the corresponding toner are executed.

In a multicopy operation in the full color mode, processes following the preliminary scanning described above are repeated.

FIGS. 15A to 15D are flow charts of the image forming process.

In this routine, an image forming state indicated by a count value of a state counter is checked at first in step #20, and the following processes are executed corresponding to respective states.

In the initial state immediately after the power on and in the standby state after the end of copying operation, the state is set to "0". In state "0", first, whether or not the print key is on is checked (step 321).

If the print key is on, the main motor 24 and the PC motor 25 are turned on and rotation driving of various portions such as the photoreceptor drum 3 is started (step #22).

Then, a motor rise timer for waiting stabilization of rotation of the motors 24 and 25 is set (step #23), and the state is set to "1" (step #24).

In state "1", updating by counting up the motor rise timer is done (step #31), and whether or not operation of the timer is completed is checked (step #32).

If the operation of the timer is completed, an output from the fur brush is turned on for cleaning the belt (step #33), and the state is set to "2" (step #34).

In state "2", whether the copy mode designated by the operation panel is the monocolor mode or full color mode is checked (step #41), and the following processes are executed corresponding to the designated mode.

If the monocolor mode is designated, a mirror rotation request (ND request), which is a flag for requesting positioning of the half mirror 36ND is set (step #42).

Consequently, the filter mirror process, which will be described later, is activated, and the half mirror 36ND is positioned at the image forming position.

Then, the corona charger 4 and the exposure lamp 33 are turned on (step #43), a scan request is set for starting scanning by the scanner 30 (step #44), one of the developing units 6 to 9 selected by the operation panel is turned on (step #45), and the state is set to "3" (step #46).

In state "3", completion of scanning of the original D is confirmed (step #41), the corona charger 4 and the exposure lamp 33 are turned off (step #62), and the developing unit which is in operation is turned off (step #63).

Then, a mirror rotation request (standby request) is set to form a latent image APE of the AIDC pattern AP (step #64).

Consequently, the half mirror 36ND (mirror apparatus 360) is moved to the standby position, thereby intercepting the scanning light from the scanner 30.

Then, a pattern formation request is set to activate AIDC pattern process (step #65), and the state is set to "4" (step #66).

In state "4", completion of formation of the AIDC pattern AP is waited (step #67), and a mirror rotation request (return request) for returning the mirror apparatus 36 to the original position is set (step #68).

Then, whether or not the next copying is requested is checked (step #69), and if there is no request of copying, the fur brush output is turned off (step #70). The main motor 24 and the PC motor 25 are turned off (step #71), and the state is returned to "0" (step #72).

Consequently, the copying machine 1 is set in the standby state.

If there is a request for the next copy, the state is returned to "2" (step #73).

If in step #41 of the above described state "2" the full color mode is designated, a request for positioning the half mirror 36ND at the home position (HOME request) for reading the original D by the image sensor 38 is set (step #47). The exposure lamp 33 is turned on (step #48), a preliminary scan request is done (step #49), and the state is set to "5" (step #50).

In state "5", completion of preliminary scanning is checked (step #75), the exposure lamp 33 is turned off (step #76) and a mirror rotation request (B request) for positioning the filter mirror 36YB at the image forming position is set (step #77). A mark detecting permission for starting scanning at an ON timing of the belt mark sensors 72 and 72*s* is set (step #78), and the state is set to "6" (step #79).

In state "6", waiting is conducted until the scanner 30 starts scanning in response to the belt mark signal (step #81), and when the scanning starts, the fur brush output is turned off (step #82), the developing unit 6 of Y toner is turned on (step #83), and the state is set to "7".

In state "7", completion of scanning is checked (step #91), and the corona charger 4 and the exposure lamp 33 are turned off (step #92). The developing unit 6 containing Y toner is turned off (step #93), and thereafter, a mirror rotation request (G request) for positioning the filter mirror 36MG at the image forming position is set (step #94). A pattern formation request is set (step #95) and the state is set to "8".

More specifically, in the full color copying, the mirrors 36*b* are switched by rotating the filter apparatus 36 by 90° for every scanning, and the scanning light is intercepted during the switching operation. By utilizing this period, the latent image APE is formed and the AIDC pattern AP is formed while the filter mirror is switched from the filter mirror 36YB to the filter mirror 36MG.

In states "8" to "13", a series of processes for forming M, C and BK toner images in the similar manner as forming Y toner image are executed. More specifically, the developing units 7, 8 and 9 corresponding to respective colors are turned on and off, the exposure lamp 33 and the corona charger 4 are turned off when scanning by the scanner 30 is completed, and the filter mirror 36CR or the half mirror 36ND corresponding to the next scanning is positioned.

During these processes, the mirror apparatus 36 rotates for positioning the filter mirror 36CR or the half mirror 36ND, enabling formation of the AIDC pattern AP. In the present embodiment, the AIDC pattern AP is not formed during this period, since correction data for the voltage of the exposure lamp 33 and of the grid voltage VG of the corona charger 4 for other colors are obtained from a data table, based on the detected signal S1 for the Y toner image.

If there is no request for the next copy in step #124 of state "13", the main motor 24 and the PC motor 25 are turned off (step #125), a mark detection permission is reset (step #126) and the state is returned to "0" (step 127).

Figure 16:
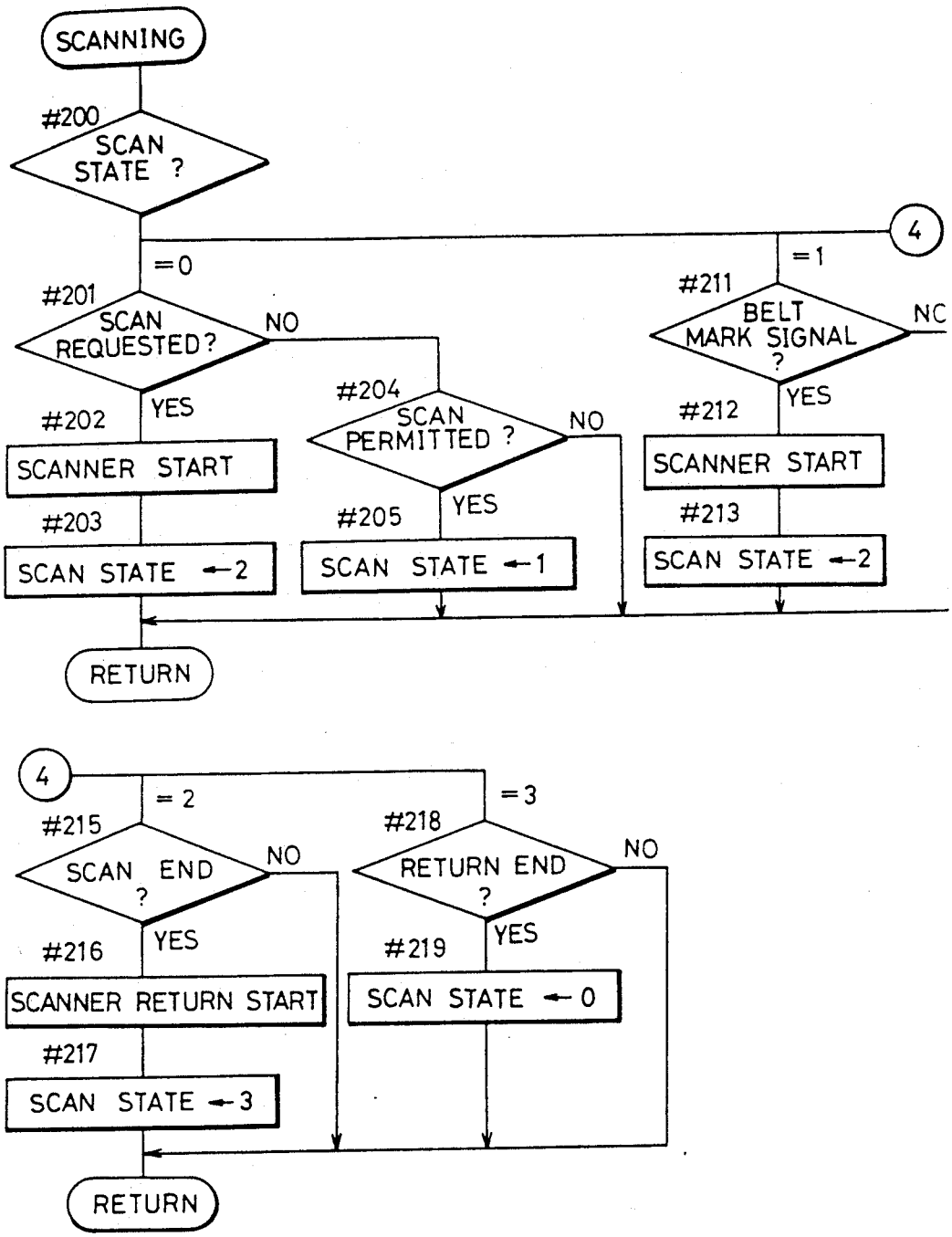
FIG. 16 is a flow chart of a scanning process.
Figure 17A:
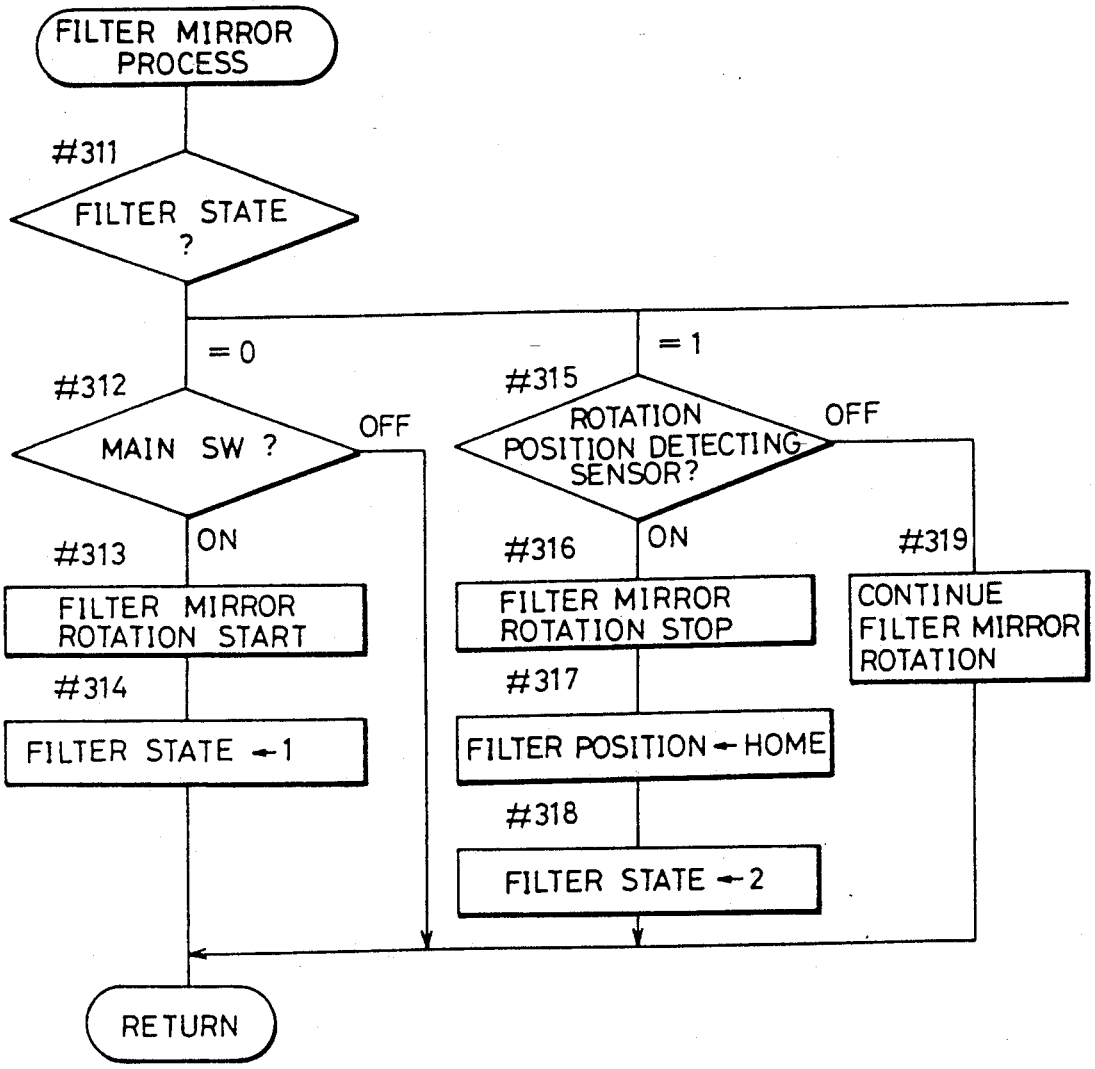
FIGS. 17A to 17D are flow charts of a filter mirror process.
Figure 17B:
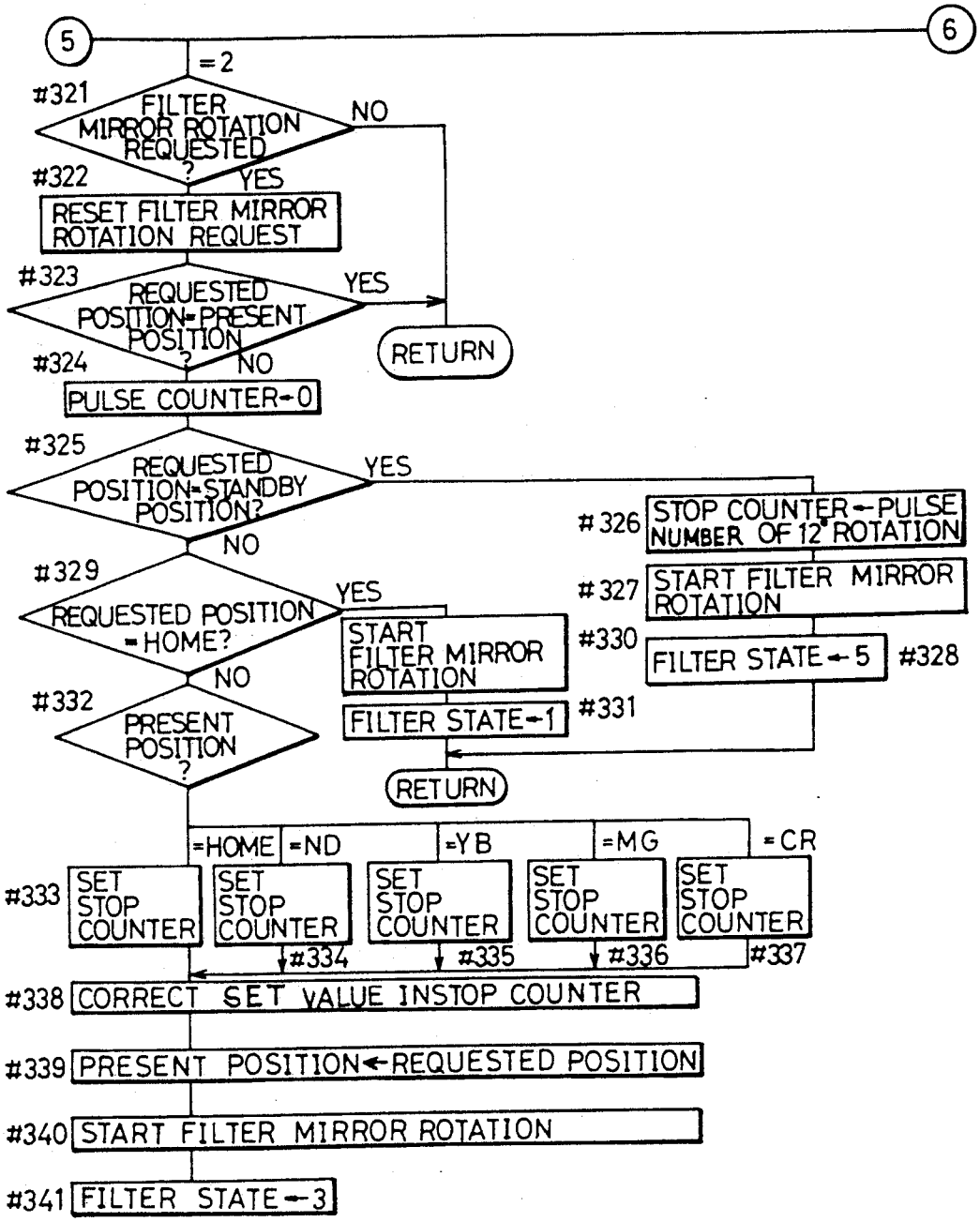
Figure 17C:
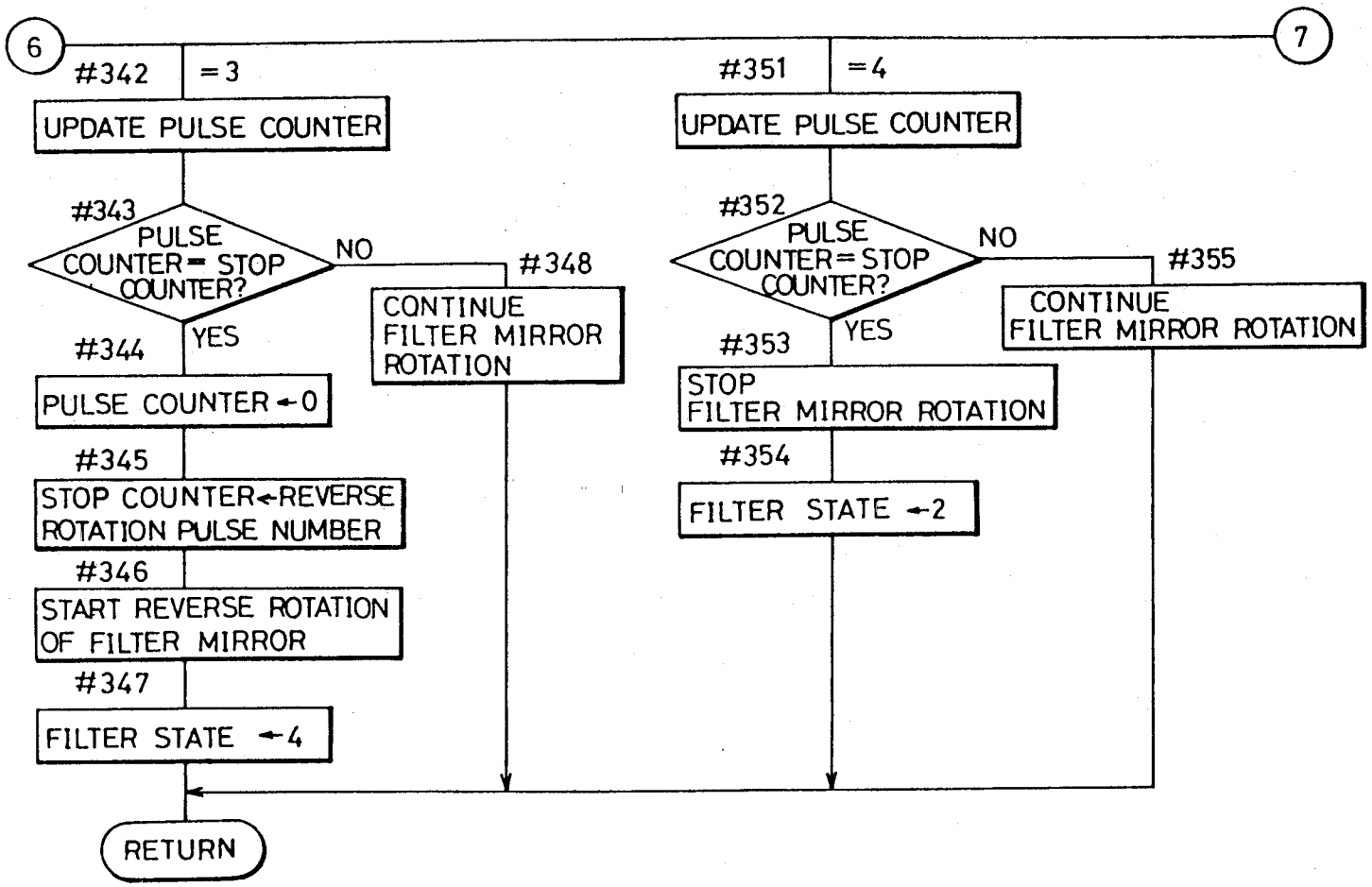
Figure 17D:
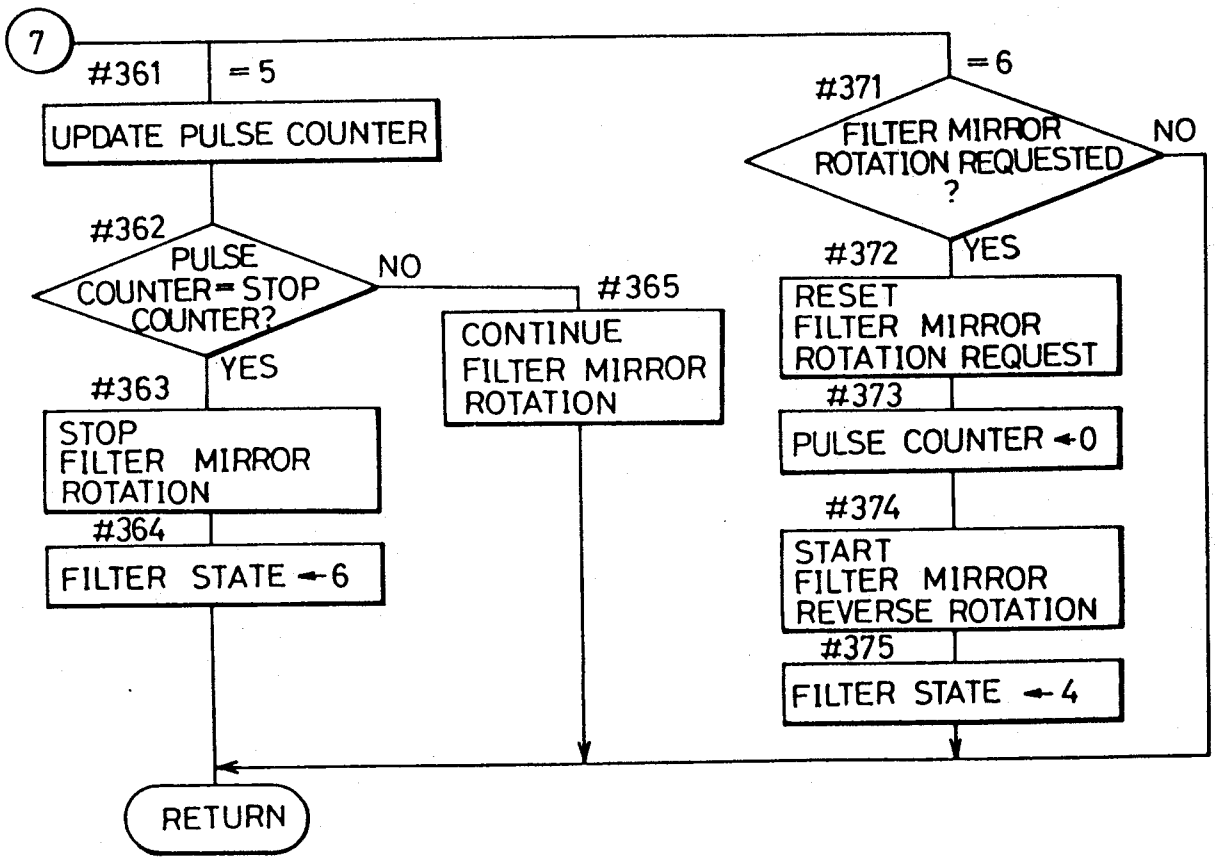

FIG. 16 is a flow chart of the scanning process

At first, scanning state is checked (step #200), and the following processes are executed corresponding to respective states.

In state "0", whether there is a scan request or not is checked (step #201), and if there is a scan request, forward movement of the scanner 30 is started (step #202).

If there is no request of scanning, whether or not there is a scan permission is checked (step #204). A flag of scan permission is set when start of scanning in response to the belt mark signal S10 is permitted. When there is the scan permission, the state is set to "1" (step #205).

In state "1", the flow waits for an output of the belt mark signal S10 (step #211), and forward movement of the scanner 30 is started (step #212). Consequently, when full color copying is done, toner images of respective colors are overlapped on the same position on the transfer belt 11.

In state "2", whether or not the scanner 30 moving forward has reached the rear end of the original D to complete scanning or not is checked (step #215).

If the scanning is completed, returning of the scanner 30 is started immediately (step #216), and the state is set to "3" (step #217).

The AIDC pattern Ap described above is formed during returning.

In state "3", the state of detection of the scanner home switch 74 is checked (step #218). After it is confirmed that the scanner 30 has returned to the home position and the returning is completed, the state is returned to the initial value of "0".

FIGS. 17A to 17D are flow charts of the filter mirror process.

At first, the filter state is checked (step #311), and the following processes are executed corresponding to the respective states.

In state "0", whether or not the main switch of the copying machine 1 is on is checked (step #312).

When the main switch is turned on, pulses are output to the pulse motor 235 to start forward rotation of the filter mirror 36*b* (that is, filter holder 211) (step #313) to know where the rotation angular position of the filter apparatus 36 is, and the state is set to "1" (step #314).

In state "1", the rotation of the filter mirror 36*b* is continued until the rotation position detecting sensor 37 is turned on (until the sensor 77 operates) (step #315, #319).

When the rotation position detecting sensor 77 is turned on, rotation of the filter mirror 36*b* is stopped (#316), and the rotation angular position of the filter holder 211 (filter position) at that time is regarded as the home position (step #317), and the state is set to "2" (step #318).

Thereafter, preliminary scanning by the scanner 30 is carried out, and the images on the original D are read by the image sensor 38.

In state "2", setting of the filter mirror rotation request flag during the image forming process described above is waited (step #321).

When the filter mirror rotation request flag is set, the flag is reset at first (step #322), and whether or not the requested position is the same as the present position is checked (step #323).

If it is yes in step #323, that is, if the positions are the same, it is not necessary to rotate the filter mirror 36*b*, and therefore the program returns.

If it is no in step #323, the pulse counter is cleared to "0" (step #324). The pulse counter counts the number of pulses outputted to the pulse motor 235, and when the counted value becomes equal to a set value of the stop counter, which will be described later, it is confirmed that the filter mirror 36*b* has reached the predetermined position.

Then, whether or not the requested position is the standby position, that is, whether or not it is a standby request, is checked (step #325).

If it is a standby request, number of pulses necessary for rotation of the filter mirror 36*b* by 12° is set in the stop counter (step #326), the rotation of the filter mirror 36*b* is started (step #327), and the state is set to "5" (step #328).

If it is not a standby request, whether or not the requested position is the home position is checked (step #329)

If it is yes, rotation of the filter mirror 36*b* is started (step #330), and the state is returned to "1" (step #331)

If it is no, the processes are branched corresponding to the present position (step #332), and corresponding to the rotation angle from the present position to the requested position, necessary number of pulses are set in the stop counter (steps #333 to #337).

The value which is to be set in the step counter corresponds to a position of the filter mirror 36*b* which has passed by a prescribed distance over the contact portion 242*a* of the stopper apparatus 213. This value is read from the data table storing the number of necessary pulses with respect to the present position and the request position.

The set value is selected to be 110° of rotation angle in the normal operation of, for example, full color mode. A set value for reverse rotation, which will be described later, is selected to be a constant value corresponding to 20° of rotation angle Therefore, the filter mirrors 36YB, 36MG, 36CR and the half mirror 36ND are rotated successively by 90° in this order to be positioned.

By adding or subtracting correction values set by a correction dip switch to the number of pulses set in the stop counter in any of the steps 333 to 337, the set value in the stop counter can be corrected (step #338). Consequently, when the filter mirror 36*b* is positioned by the reverse rotation of the pulse motor 235 later, variation due to mechanical dimensional error of the filter apparatus 36 can be made up for, to ensure that the filter mirrors 36*b* to be positioned is free from the side plate 221 in the support hole 224.

More specifically, in the copying machine 1 of the present embodiment, positioning of the filter mirror 36*b* is carried out by two adjustments, that is, adjustment of rotation angle by the correction dip switch, and adjustment of the home position realized by adjusting position of the rotation position detecting sensor 77 described above.

Then, the requested position is reset as the present position (step #339), pulses are output to the pulse motor 235 to start rotation of the filter mirror 36*b* (step #340), and the state is set to "3" (step #341).

In state "3", 1 is added to the counted value of the pulse counter and the counted value is updated (#step #342), and whether or not the counted value of the pulse counter is equal to the set value of the stop counter is checked (step #343). Rotation of the filter mirror 36*b* is continued until these values become equal to each other (step #348).

If it is yes in step #343, it means that the filter mirror 36*b* has reached the predetermined position over the contact portion 242*a*, and therefore rotation in the reverse direction is started.

Namely, the pulse counter is cleared (step #344), the number of pulses corresponding to the angle of rotation of reverse rotation of the filter mirror 36*b* is set in the stop counter (step #345), pulses for reverse rotation are output to the pulse motor 235 to start reverse rotation of the filter mirror 36*b*, and the state is set to "4" (step #347).

In state "4", processes for reverse operation of the mirror apparatus 36 is carried out.

At first, the pulse counter is updated (step #351), and then whether or not the counted value of the pulse counter is equal to the set value of the stop counter is cnecked (step #352). Rotation of the filter mirror 36*b* is continued until these values are equal to each other (step #355).

If it is yes in step #352, it means that the filter mirror 36*b* is positioned in contact with the contact portion 242*a*, so that the pulse motor 235 is stopped and the rotation of the filter mirror 36*b* is stopped (step #353).

Then the state is returned to "2" (step #354), and the program is kept in the standby state until the next filter mirror rotation request flag is set.

Then, process for setting the mirror apparatus 36 at the standby state for forming AP is carried out.

At first, the pulse counter is updated (step #361), whether or not the counted value of the first counter is equal to the set value of the stop counter is determined (step #362), and rotation of the mirror apparatus 36 is continued until the values become equal to each other (step #365).

If it is yes in step #362, the pulse motor 235 is stopped to stop rotation of the mirror apparatus 36 (step #363), and the state is set to "6" (step #364).

In state "6", returning process of the mirror apparatus 36 is carried out.

First, the program waits for the setting of the mirror rotation request (step #371). If it is set, the flag is reset (step #372), the pulse counter is cleared (step #373), reverse rotation of the mirror apparatus 36 is started (step #374), and the state is set to "4" (step #375).

Figure 18A:
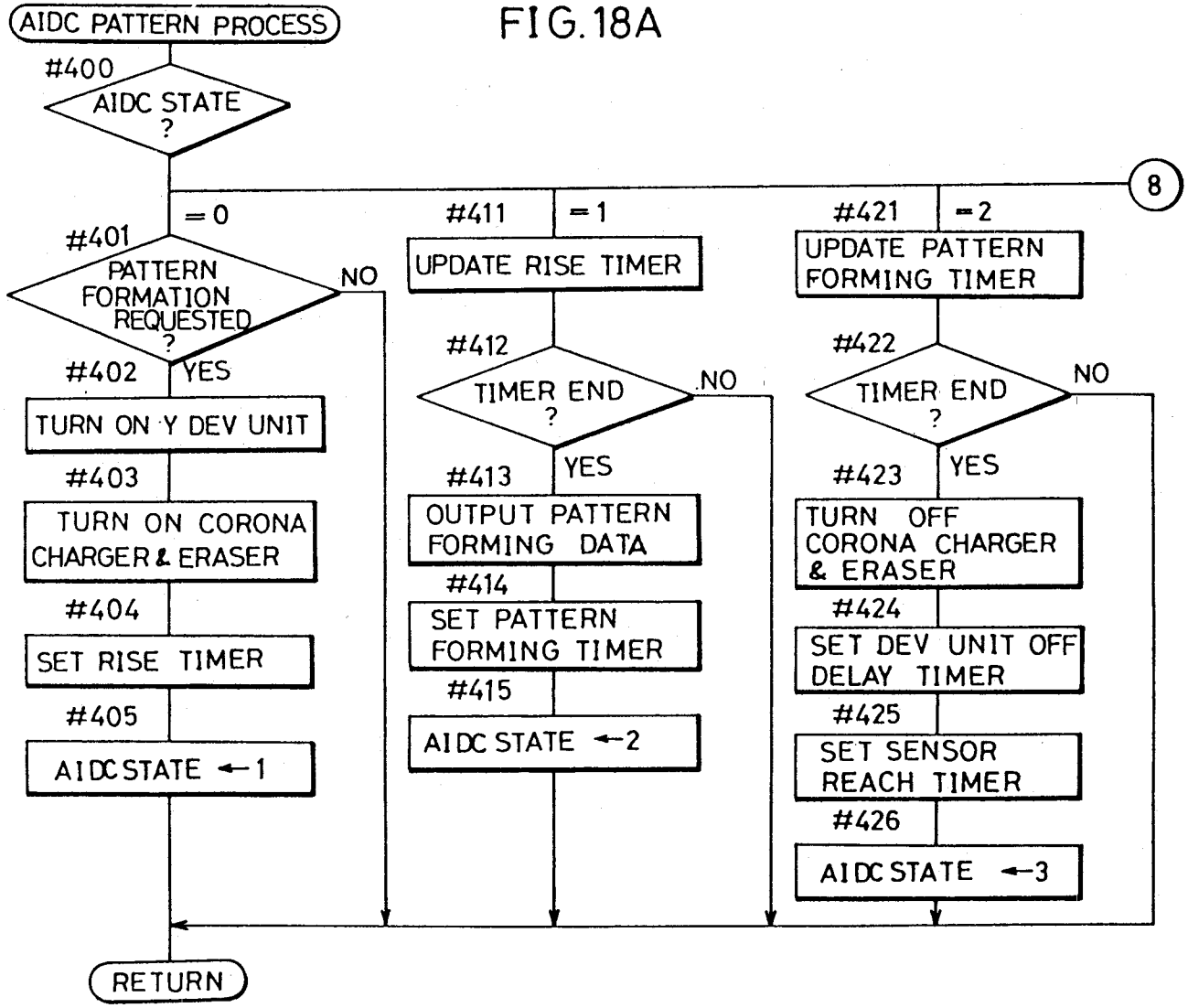
FIGS. 18A to 18B are flow charts of AIDC pattern process.
Figure 18B:
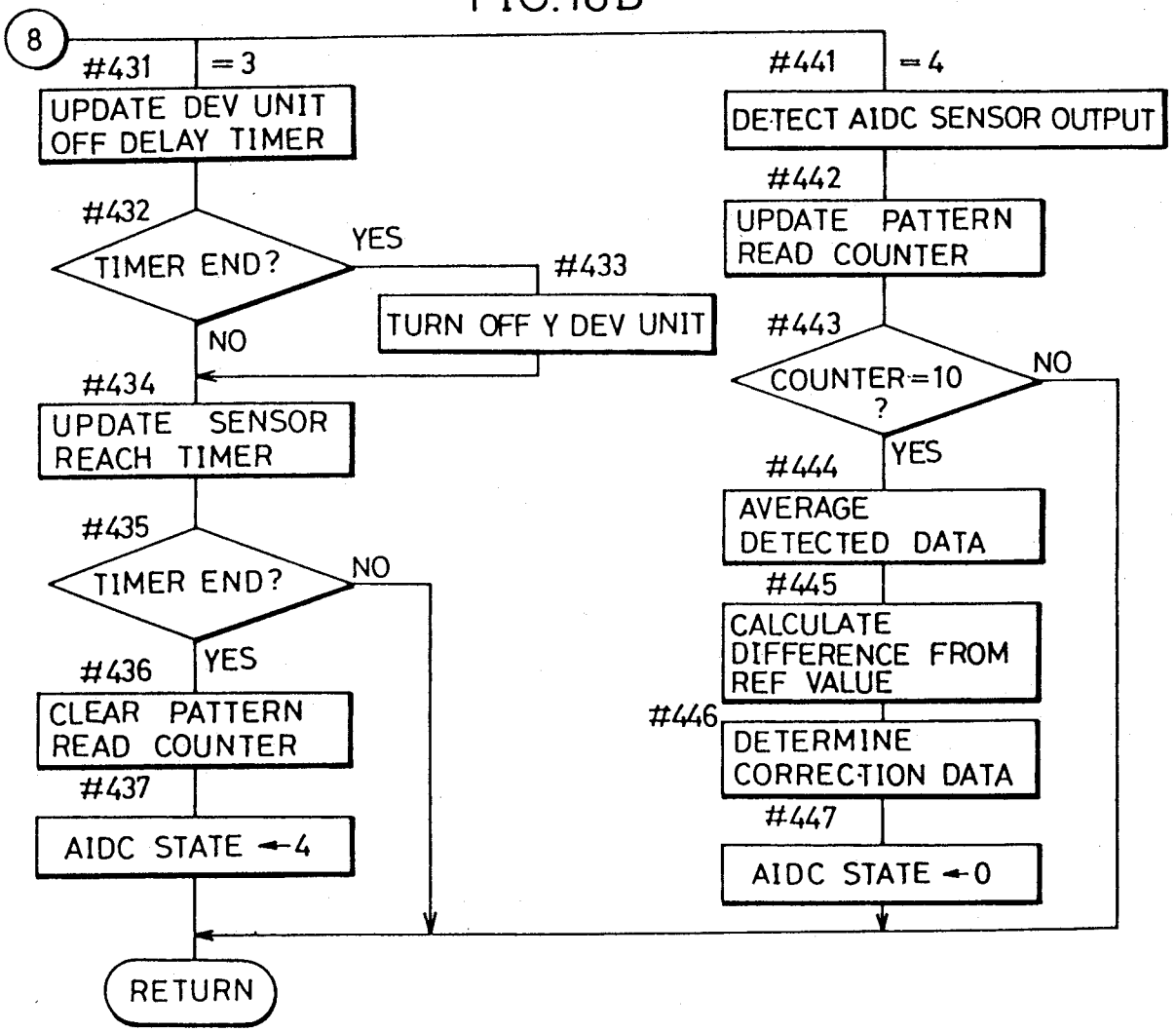

FIGS. 18A to 18B are flow charts of the AIDC pattern process.

At first, the AIDC state is checked (step #400), and the following processes are executed corresponding to the respective states.

In state "0", the program waits for setting of a pattern formation request by the image forming process (step #401).

If it is yes, the developing unit 6 containing Y toner for forming the pattern is turned on (step #402), the corona charger 4 and the edition eraser 5 are turned on (step #403), a rise timer is set (step #404), and the state is set to "1" (step #405).

At this time, the grid voltage VG of the coronal charger 4 is at a constant value determined for forming the AIDC pattern AP. In the rise timer, time taking in account the width of the corona charger 4 and the distance to the edition eraser 5 is set, and at that position of the photoreceptor drum 3 which corresponds to this time, the AIDC pattern AP is formed.

In state "1", the rise timer is updated (step #411), waiting is conducted until completion of the operation of the rise timer (step #412), eraser data for forming the AIDC pattern AP are output to the edition eraser 5 (step #413), and formation of the latent image APE is started.

Then, a pattern formation timer for defining the length L2 of the AIDC pattern AP is set (step #414), and the state is set to "2" (step #415).

In state "2", the pattern formation timer is updated (step #421), completion of the operation of the pattern formation timer is waited (step #422), and then the corona charger 4 and the edition eraser 5 are turned off (step #423).

Consequently, the latent image APE is formed at a prescribed position on the photoreceptor drum 3 (see FIG. 2).

Then, a developing unit off delay timer is set (step #424), a sensor reach timer is set (step #425), and the state is set to "3" (step #426).

In the developing unit off delay timer, time corresponding to the distance between the edition eraser 5 and the developing unit 6 of Y is set to allow development of the whole latent image APE, and in the sensor reach timer, time required for the AIDC pattern AP to reach the detection position of the AIDC sensor 73 is set.

In state "3", the developing unit off delay timer is updated (step #431), the completion of the operation of the developing unit off delay timer is waited (step #432), and the developing unit 6 of Y is turned off (step #433).

Then, the sensor reach timer is updated (step #434), and after the operation of the sensor reach timer is completed (step #435), a pattern read counter is cleared (step #436), and the state is set to "4" (step #437).

The pattern read counter counts the number of reading AIDC patterns AP, and in this embodiment, it counts ten times.

In state "4", the detection signal S1 of the AIDC a sensor 73 is read (step #441), the pattern read counter is updated (step #412), and when the counted value reaches 10 (step #443), detected data of 10 times are averaged (step #444).

The detection is carried out for 10 times in consideration of fluctuation of the detection signal S1, and by taking mean value, reliability is improved.

Then, difference between the detected data and the reference value is calculated (step #445).

By doing so, how much the present image density is off from the reference is recognized.

Then correction data for the corona charger 4 and the exposure lamp 33 in respective modes are determined (step #446).

The correction data are read from the data table based on the value calculated in step #445. In the data table, correction data for the grid voltage VG of the corona charger and for the voltage of the exposure lamp 33 in respective modes (full color yellow, full color magenta, full color cyan and monocolor) are stored.

Therefore, by forming the AIDC pattern AP for only one color, correction data for all other colors can be determined.

Then, the state is returned to "0" (step #447) and the program waits for the next activation.

Figure 19:
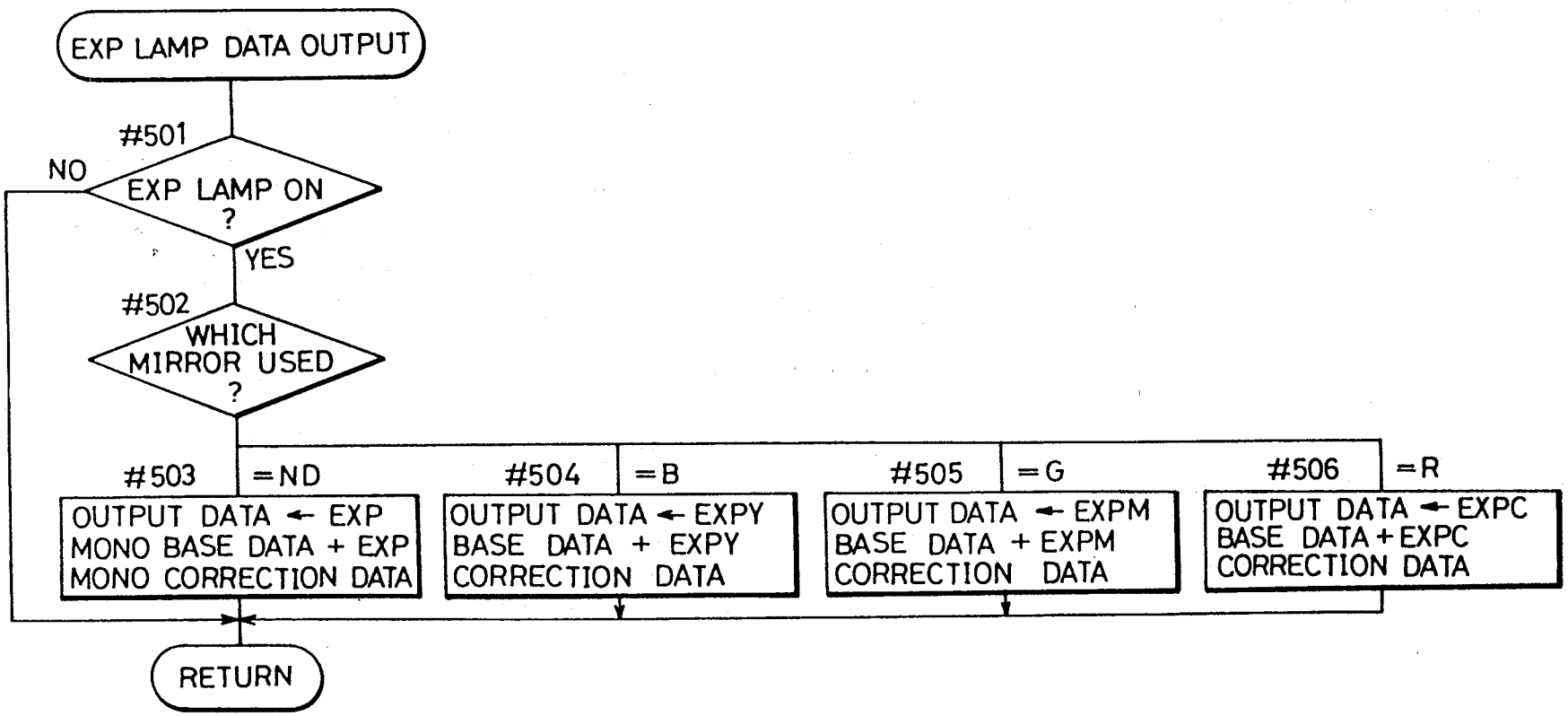
FIG. 19 is a flow chart showing exposure lamp data output process.

FIG. 19 is a flow chart showing exposure lamp data output process.

At first, whether or not the exposure lamp 33 is turned on is checked (step #501).

If the exposure lamp 33 is turned on, the process is branched dependent on which mirror 36*b* is used (step #502)

When the half mirror 36ND is to be used, data provided by adding EXP correction data for monocolor determined in the step #446 to EXP base data for monocolor which is determined beforehand are output (step #503).

In the similar manner, when the filter mirror 36YB, 36MG or 36CR is to be used, data provided by adding EXP correction data of Y, M or C determined in the steps #446 to the EXP base data of Y, M or C determined beforehand are output (step #504 to #506).

Figure 20:
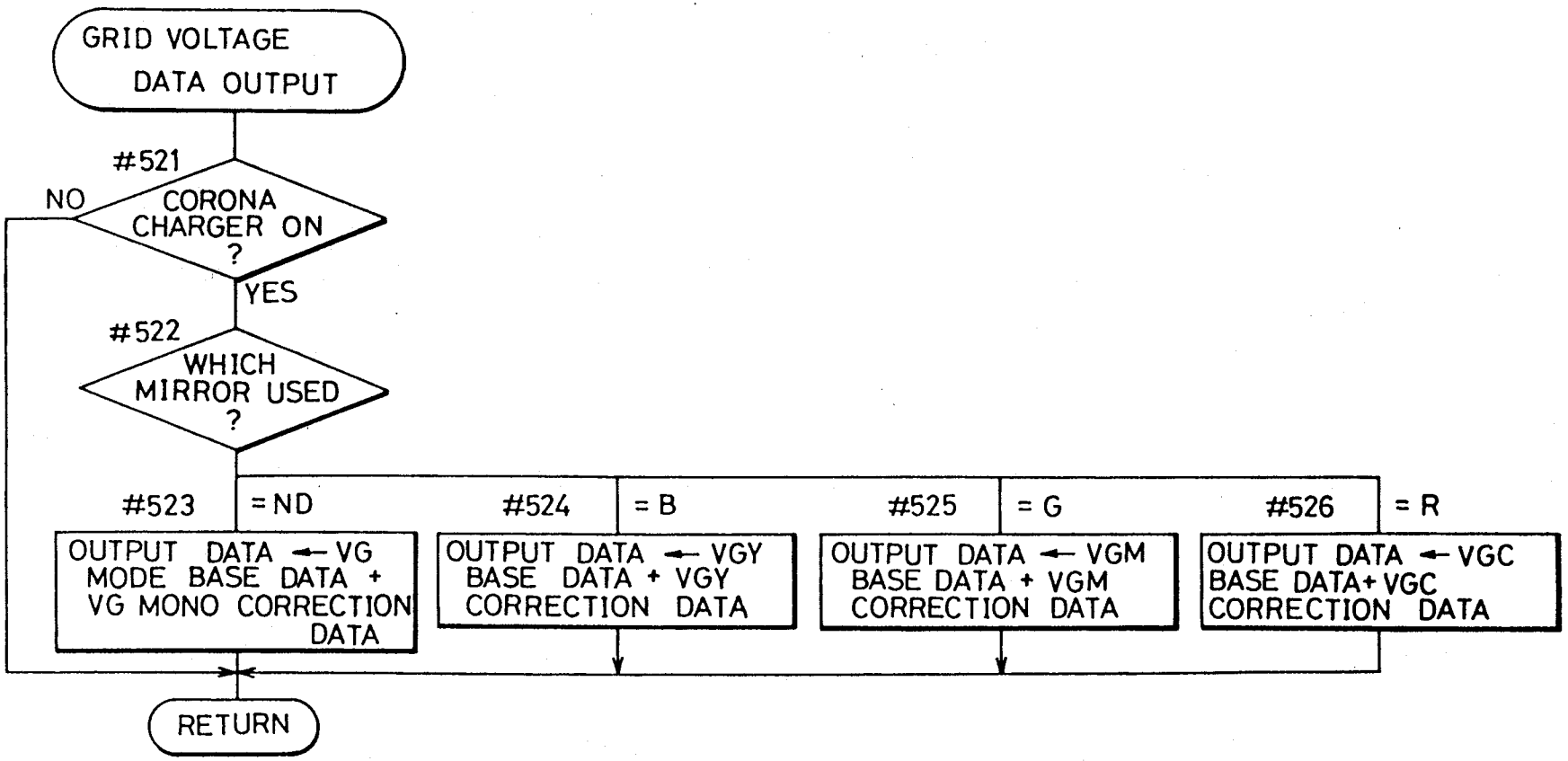
FIG. 20 is a flow chart of a grid voltage data output process.

FIG. 20 is a flow chart of the grid voltage data output process.

First, whether or not the corona charger 4 is turned on is checked (step #521).

If the corona charger 4 is turned on, the process is branched based on which mirror 36*b* is used (step #522).

When the half mirror 36ND is to be used, data provided by adding VG correcting data for monocolor determined in step #446 to the VG base data for monocolor determined beforehand are output (step #523).

Similarly, when the filter mirror 36YB, 36MG or 36CR is to be used, data provided by adding VG correction data for Y, M or C determined in step #446 to the VG base data for Y, M or C determined beforehand are output (steps #524 to #526).

In the above described embodiment, by moving to the standby position the mirror apparatus 36 having 4 mirrors 36*b* provided movable between an image forming position and a standby position for full color copying, scanning light to the photoreceptor drum 3 is intercepted, and the latent image APE for the AIDC pattern AP is formed. Therefore, special apparatus for intercepting the scanning light is not necessary. Especially when full color copying is to be done, the latent image APE is formed during switching rotation of the mirror apparatus 36, so that control for forming the AIDC pattern AP is very simple.

Compared with an apparatus intercepting the scanning light by turning off the exposure lamp 33, it is not necessary to wait for the turning off time and turning on time of the exposure lamp 33, and therefore the AIDC pattern AP can be formed without extra time. Namely, even when multiple copies are to be taken, speed of copying is not lowered for forming the AIDC pattern AP.

Compared with a case in which the latent image APE is formed by irradiating a black pattern for forming the AIDC pattern AP by the exposure lamp 33, density fluctuation due to stain or dirt on the black pattern is eliminated, so that proper AIDC pattern AP can be formed easily.

In addition, since the AIDC pattern AP is formed only for one color and density adjustment is carried out based on correction data for other colors, the number of forming the AIDC pattern AP can be reduced, thereby preventing wasteful consumption of toner.

Although the AIDC pattern AP is formed by using Y developing unit 6, the pattern may be formed by using any of the remaining developing units 7 to 9 of the specific colors, or it may be formed by using one of the developing units 6 to 9 which is selected in the copying operation. In that case, the correction data may be determined in step #446 corresponding to that one of the developing units 6 to 9 used.

Although there have been 4 filter mirrors 36*b* in the above described embodiment, three or less filter mirrors or five or more filter mirrors may be used. Although description was given of a case in which the filter mirrors 36*b* are provided on a radial line with the axis 36*a* being the center, they may not be arranged radially. Although the reflection surface of each filter mirror 36*b* has been brought into contact with the contact portion 242*a* for positioning the filter mirror 36*b*, the rear surface of the filter mirror 36*b* may be brought into contact. Although three stopper apparatuses 213 are used for supporting at three points, one stopper apparatus 213 may have two contact portions 242*a*. Support by four points, support by linear contact or support by area contact is possible.

In the above described embodiment, the set value in the stop counter is corrected in step #34 of the flow chart for adjusting positioning of the filter mirror 36*b*. Alternatively, the set pulse number for reverse rotation set in step #44 may be corrected.

In the above described embodiment, by using the axis 36*a* of the filter apparatus 36 as a scan wired driving axis, the mechanism may be simplified and the apparatus can be made compact, reducing cost.

Further, the structures, shapes, dimension, materials and so on of the filter holder 211, the rotary driving portion 212, the stopper apparatuses 213, the filter apparatus 36 and other various portions of the copying machine 1 may be appropriately modified.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus comprising:
a photosensitive member;
an illumination system for illuminating an image of an original; and
filter device including a rotatable filter holder holding a plurality of filter mirrors for color-separating the light reflected from the original image and reflecting the light to the photosensitive member.

2. An image forming apparatus as claimed in claim 1 wherein at least one of said filter mirrors is capable of transmitting the light reflected from the original image.

3. An image forming apparatus as claimed in claim 2, wherein an image sensor is disposed at the downstream side of the filter device with respect to a light incident direction into the filter mirror for receiving the light transmitted by the filter mirror.

4. An image forming apparatus as claimed in claim 1, wherein the filter holder is arranged at a frame of the image forming apparatus, further comprising:
drive means for driving the filter holder so as to rotate;
support means disposed at the filter holder for movably supporting the filter mirrors in forward and reverse rotating directions of the filter holder;
urging means provided at the filter holder for urging the filter mirrors supported by said support means in at least either of the rotating directions; and
positioning means arranged at the frame of the image forming apparatus for positioning the filter mirrors by contacting with surfaces of the filter mirrors urged by said urging means at a contacting portion thereof.

5. A filter device in an image forming apparatus for color-separating the light reflected from an original image following the illumination of the original image by an illumination system, said filter device comprising:
a plurality of filter mirrors for color-separating the light reflected from the original image; and
a rotatable filter holder provided at a frame of the image forming apparatus for holding the filter mirrors to be movable in forward and reverse rotating directions of the rotatable filter holder.

6. A filter device as claimed in claim 5 wherein the plurality of filter mirrors include reflective mirrors and at least one transmissible mirror.

7. A method carried out in an image forming apparatus having a photosensitive member, an illumination system for illuminating an image of an original, and a filter device having a rotatable filter holder for holding a plurality of filter mirrors for color-separating the light reflected from the original image, said method comprising the steps of:
proving a stopper at a frame of the image forming apparatus;
first rotating the filter holder in a predetermined direction;
second rotating the filter holder in a direction opposed to the predetermined direction after a desirable filter mirror passes the position wherein said stopper is provided; and
contacting a surface of the desirable filter mirror with the stopper in order to position the desirable filter mirror.

8. An image forming apparatus comprising:
a photosensitive member;
an illumination system for illuminating an image of an original;
a movable mirror device for color-separating the light reflected from the original image, said mirror device directing the reflected light to the photosensitive member in a first position and directing the reflected light to other direction than the photosensitive member in a second position;
moving means for moving said mirror device between the first and second positions;
control means for controlling said moving means so as to move the mirror device to the second position for the image density adjustment;
forming means for forming an electrostatic latent image of a standard pattern for the image density adjustment on the photosensitive member when the mirror device is in the second position; and
developing means for developing said electrostatic latent image of the standard pattern for the image density adjustment.

9. An image forming apparatus as claimed in claim 8, wherein said mirror device has a plurality of filter mirrors.

10. An image forming apparatus as claimed in claim 9, wherein said moving means includes a rotatable filter holder for holding said filter mirrors and driving means for rotating said filter holder.

11. An image forming apparatus comprising:
a photosensitive member;
an illumination system for illuminating an image of an original;
a mirror device including a rotatable filter holder holding a plurality of filter mirrors for color-separating the light reflected from the original image;
rotating means for rotating said mirror holder;
positioning means for positioning the rotating filter mirrors so that the light reflected from the original image is directed to the photosensitive member;
forming means for forming an electrostatic latent image of a standard pattern for the image density adjustment during the filter mirror rotation; and
developing means for developing the electrostatic latent image of the standard pattern for the image density adjustment.

12. A method for adjusting an image density in an image forming apparatus comprising a photosensitive member, an illumination system for illuminating an original image, and a movable mirror device for color-separating the light reflected from the original image, said method comprising the steps of:
moving the mirror device from a first position to the second position, the mirror device directing the reflected light to the photosensitive member in the first position and directing the reflected light to other direction than the photosensitive member in the second position;
forming an electrostatic latent image of a standard pattern for the image density adjustment on the photosensitive member when the mirror device is in the second position; and
developing the electrostatic latent image of the standard pattern.

* * * * *

UNITED STATES PATENT AND TRADEMARK OFFICE

CERTIFICATE OF CORRECTION

PATENT NO. : 5,253,031

DATED : October 12, 1993

INVENTOR(S) : Naoyoshi Kinoshita, et al.

It is certified that error appears in the above-indentified patent and that said Letters Patent is hereby corrected as shown below:

In Col. 1, line 13, change "therefore" to --therefor--.

In Col. 1, line 62, after "filters", insert --.-- (period).

In Col. 1, line 66, after "colors", insert --.-- (period).

In Col. 7, line 23, change "bet" to --belt--.

In Col. 9, line 67, change "fame" to --frame--.

In Col. 19, line 6, after "AIDC", delete "a".

In Col. 21, line 61 (Claim 7, line 8), change "proving" to --providing--.

In Col. 22, line 56 (Claim 12, line 7), change "the" (second occurrence) to --a--.

Signed and Sealed this

Seventh Day of June, 1994

Bruce Lehman

*Attest:*

BRUCE LEHMAN

*Attesting Officer*

*Commissioner of Patents and Trademarks*